US007971543B2

(12) United States Patent
Nagai et al.

(10) Patent No.: US 7,971,543 B2
(45) Date of Patent: Jul. 5, 2011

(54) SEWING MACHINE AND COMPUTER-READABLE RECORDING MEDIUM STORING SEWING MACHINE OPERATION PROGRAM

(75) Inventors: Masahiko Nagai, Nagoya (JP); Tsuneo Okuyama, Inabe-gun (JP); Masashi Tokura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 536 days.

(21) Appl. No.: 12/071,784

(22) Filed: Feb. 26, 2008

(65) Prior Publication Data

US 2008/0216721 A1 Sep. 11, 2008

(30) Foreign Application Priority Data

Mar. 6, 2007 (JP) ..... 2007-056078
Nov. 14, 2007 (JP) ..... 2007-295373

(51) Int. Cl.
*D05B 19/02* (2006.01)
*D05C 5/02* (2006.01)

(52) U.S. Cl. ..... 112/102.5; 112/470.18; 700/138

(58) Field of Classification Search ..... 112/102.5, 112/470.01, 470.04, 470.14, 470.18, 221, 112/222; 700/130–138
See application file for complete search history.

(56) References Cited

U.S. PATENT DOCUMENTS 4,388,883 A * 6/1983 Hirota et al. ..... 112/102.5
4,403,559 A 9/1983 Hirose
4,860,678 A * 8/1989 Skogward ..... 112/470.04
4,936,233 A 6/1990 Tajima et al.
4,976,552 A 12/1990 Ishikawa et al.
5,218,916 A * 6/1993 Kurono et al. ..... 112/102.5
5,537,946 A * 7/1996 Sadeh et al. ..... 112/475.03
5,826,526 A 10/1998 Tomita
5,836,260 A * 11/1998 Kawaguchi et al. ..... 112/277
5,957,070 A * 9/1999 Yoshida et al. ..... 112/470.04
6,161,491 A * 12/2000 Takenoya et al. ..... 112/102.5
6,256,551 B1 * 7/2001 Muto ..... 700/138
6,352,043 B1 3/2002 Tajima et al.

(Continued)

FOREIGN PATENT DOCUMENTS

JP A-56-130181 10/1981

(Continued)

OTHER PUBLICATIONS

Noriharu Tashiro et al., U.S. Appl. No. 12/900,142, filed Oct. 7, 2010.

(Continued)

*Primary Examiner* — Ismael Izaguirre
(74) *Attorney, Agent, or Firm* — Oliff & Berridge PLC

(57) ABSTRACT

A sewing machine includes a needle bar, a needle bar vertical movement mechanism, a sewing machine motor for driving the needle bar vertical movement mechanism as a drive source, an embroidery frame that holds a work cloth, and an embroidery frame movement mechanism that moves the embroidery frame. The sewing machine further includes a user-operated operation device with an operation member for outputting an output signal corresponding to an operation state of the operation member and a movement determination device that determines a movement direction and a movement distance of the embroidery frame based on the output signal outputted by the operation device. The sewing machine also includes an embroidery frame movement mechanism control device that drives the embroidery frame movement mechanism to move the embroidery frame according to the movement direction and the movement distance of the embroidery frame.

9 Claims, 16 Drawing Sheets

U.S. PATENT DOCUMENTS

| | | | | |
|---|---|---|---|---|
| 6,932,005 | B2 | 8/2005 | Tajima | |
| 7,069,870 | B2 | 7/2006 | Orii et al. | |
| 7,079,917 | B2 * | 7/2006 | Taguchi et al. | 700/138 |
| 7,239,935 | B2 | 7/2007 | Katagiri | |
| 7,460,925 | B2 | 12/2008 | Noguchi | |
| 7,715,940 | B2 * | 5/2010 | Muto et al. | 700/138 |
| 2003/0056702 | A1 | 3/2003 | Tamai | |
| 2006/0137582 | A1 * | 6/2006 | Kawabe et al. | 112/102.5 |
| 2008/0216721 | A1 | 9/2008 | Nagai et al. | |
| 2008/0216725 | A1 | 9/2008 | Tokura et al. | |
| 2008/0257240 | A1 | 10/2008 | Grufman et al. | |

FOREIGN PATENT DOCUMENTS

| | | |
|---|---|---|
| JP | A-56-166887 | 12/1981 |
| JP | A-01-099594 | 4/1989 |
| JP | A-03-143473 | 6/1991 |
| JP | 5245277 A | 9/1993 |
| JP | A-06-240557 | 8/1994 |
| JP | A-09-010455 | 1/1997 |
| JP | B2-2733769 | 1/1998 |
| JP | A-10-146481 | 6/1998 |
| JP | B2-2904822 | 3/1999 |
| JP | B2-2953018 | 7/1999 |
| JP | A-2001-321587 | 11/2001 |
| JP | A-2005-193027 | 7/2005 |
| JP | A-2006-020664 | 1/2006 |
| JP | A-2006-026147 | 2/2006 |
| JP | A-2006-026148 | 2/2006 |
| JP | A-2006-026149 | 2/2006 |
| JP | A-2006-271799 | 10/2006 |
| JP | A-2008-246186 | 10/2008 |

OTHER PUBLICATIONS

Tsuneo Okuyama et al., U.S. Appl. No. 12/900,090, filed Oct. 7, 2010.

Oct. 18, 2010 Notice of Allowance issued in U.S. Appl. No. 12/071,782.

Jun. 28, 2010 Office Action for U.S. Appl. No. 12/071,782.

* cited by examiner

SEWING MACHINE AND COMPUTER-READABLE RECORDING MEDIUM STORING SEWING MACHINE OPERATION PROGRAM

CROSS-REFERENCE TO RELATED APPLICATION

This Application claims priority from JP 2007-56078, filed Mar. 6, 2007 and JP 2007-295373, filed Nov. 14, 2007, the content of which are hereby incorporated by reference in their entirety.

BACKGROUND

This disclosure generally relates to technical fields including a sewing machine and a computer-readable recording medium storing a sewing machine operation program. More specifically, this disclosure relates to a sewing machine, which includes an operation device capable of instructing movement of an embroidery frame. This disclosure also relates to a computer-readable recording medium storing a sewing machine operation program, which may be used to operate the sewing machine.

Conventionally, some sewing machines, which are capable of stitching a plurality of stitch patterns, are constructed so that a feed dog provided at a sewing machine bed may be switched into a normal state and a drop feed state. In the normal state, the feed dog moves a work cloth by protruding intermittently from a top surface of a needle plate provided at the sewing machine bed. In the drop feed state, the feed dog does not protrude from the top surface of the needle plate, and does not move the work cloth. Sewing in the drop feed state is conducted when a user carries out sewing so as to move the work cloth by means of a manual operation.

For example, in recent years, in the field of quilting, a decorative work piece may be fabricated with mere stitching of the work cloth. In this case, it is desired that a feed direction or a feed amount of the work cloth is arbitrarily changed, so that, with the feed dog being in the drop feed state, sewing may be carried out while the work cloth may freely move by means of a user's manual operation. Such a manner of sewing is referred to as free-motion sewing.

However, at the time of carrying out the free-motion sewing, when a stitch pattern unsuitable for free-motion sewing (such as, over casting or buttonhole sewing, for example) has been selected, a beautiful stitch shape may sometimes not be obtained. To solve such a problem, there has been proposed a sewing machine provided with an announcing means for, when a feed dog is in a drop feed state, announcement whether a stitch pattern selected by a pattern selection means is adaptive to be stitched in the drop feed state (for example, Japanese Patent Application Laid-open Publication No. 10-146481). According to the conventional sewing machine, a stitch pattern suitable for free-motion sewing may be stitched based on a result of the announcement, and operability of the sewing machine may be improved.

SUMMARY

However, in the conventional sewing machine described above, there has been a problem moving the work cloth to a desired position is difficult for a user who is unfamiliar with free-motion sewing, and a stitch cannot be well-formed at the desired position. In addition, in free-motion sewing, stitches may look unattractive if respective stitch lengths (pitches) are not uniform. Therefore, it is desirable to make the respective stitch lengths as uniformly as possible. However, it has been difficult for a user unfamiliar with free-motion sewing to carry out the free-motion sewing in such a manner as to form stitches with a substantially uniform stitch length while moving the work cloth in a desired direction. In addition, there may be a case in which the stitch formed by free-motion sewing is difficult to visualize depending on a color pattern of the work cloth or a thread color. In this case, it is difficult to carry out sewing while checking the stitch that has already been formed.

Various exemplary embodiments of the broad principles herein provide a sewing machine, which is capable of executing free-motion sewing by means of simple operation, and a computer-readable recording medium storing a sewing machine operation program for the sewing machine.

Exemplary embodiments provide a sewing machine including a needle bar, a sewing needle attached to the needle bar, a needle bar vertical movement mechanism that vertically moves the needle bar, a sewing machine motor that drives the needle bar vertical movement mechanism, an embroidery frame that holds a work cloth, an embroidery frame movement mechanism that moves the embroidery frame, an operation device including an operation member to be operated by a user, the operation device outputting an output signal corresponding to an operation state of the operation member, a movement determination device that determines a movement direction and a movement distance of the embroidery frame based on the output signal outputted by the operation device, and an embroidery frame movement mechanism control device that drives the embroidery frame movement mechanism to move the embroidery frame according to the movement direction and the movement distance of the embroidery frame determined by the movement determination device.

Exemplary embodiments also provide a computer-readable recording medium storing a sewing machine operation program for a sewing machine including an embroidery frame that holds a work cloth, an embroidery frame movement mechanism that moves the embroidery frame, and an operation device including an operation member to be operated by a user and outputting an output signal corresponding to an operation state of the operation member, the program including instructions for acquiring an output signal corresponding to an operation state of the operation member, instructions for determining a movement direction and a movement distance of the embroidery frame based on the output signal, and instructions for driving the embroidery frame movement mechanism to move the embroidery frame according to the movement direction and the movement distance of the embroidery frame.

BRIEF DESCRIPTION OF THE DRAWINGS

Exemplary embodiments of the invention will be described below in detail with reference to the accompanying drawings in which.

DETAILED DESCRIPTION OF THE EXEMPLARY EMBODIMENTS

Hereinafter, a first embodiment and a second embodiment will be described with reference to the accompanying drawings. The first and second embodiments each may be provided as one example of applying this disclosure to a sewing machine for moving a work cloth relative to a vertically moving sewing needle to form a stitch on the work cloth. First, a physical configuration and an electrical configuration of a sewing machine 1 common to the first and second embodiments will be described.

Figure 1:
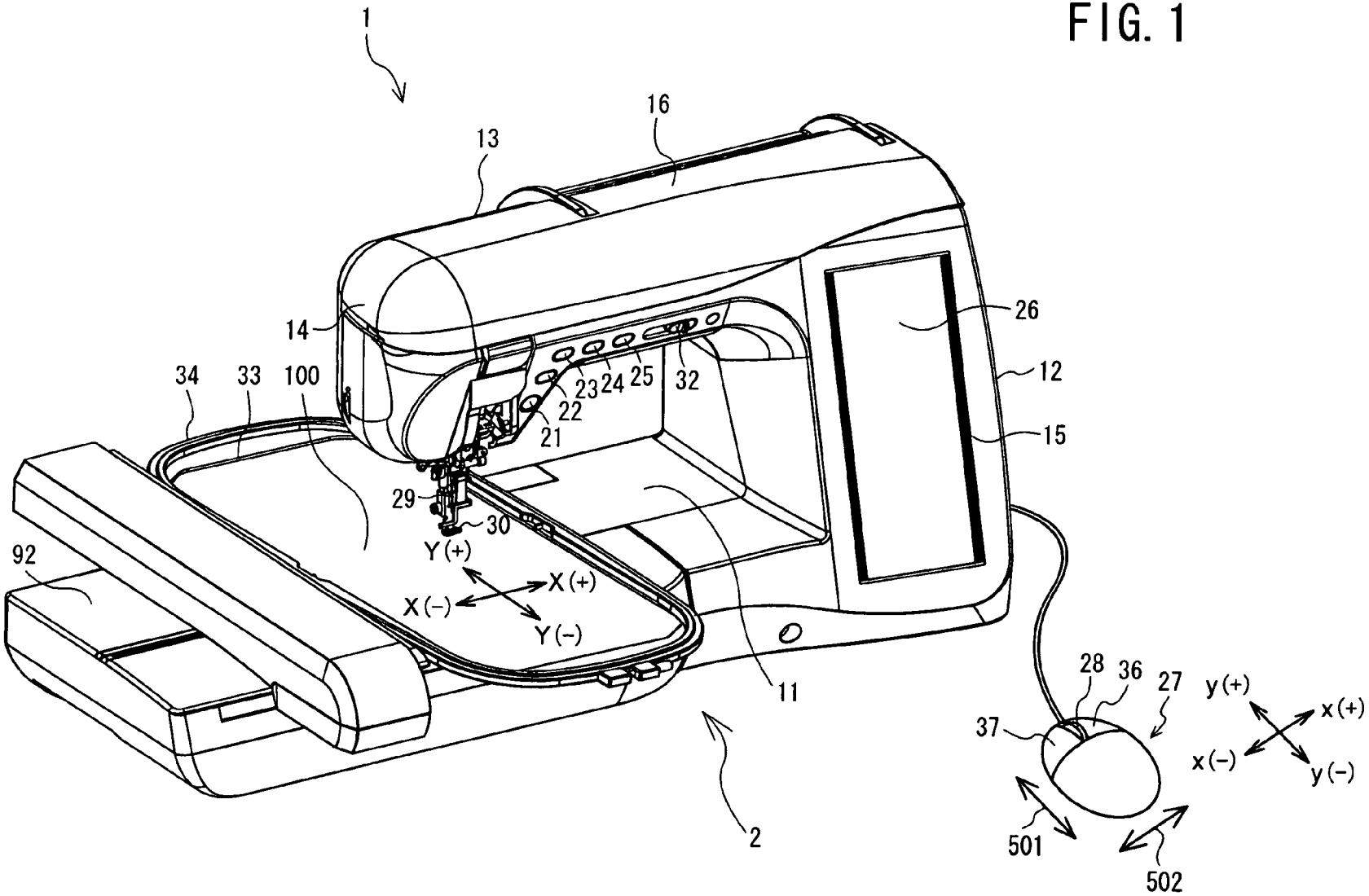
FIG. 1 is a perspective view of a sewing machine provided with an embroidery frame.

The physical configuration of the sewing machine 1 will be described with reference to, for example, FIG. 1 and FIG. 2. In FIG. 1, a front side of paper is referred to as a "front side" of the sewing machine 1, a rear side of paper is referred to as a "rear side" of the sewing machine 1, and a transverse direction of paper face is referred to as a "transverse direction" of the sewing machine 1.

As shown in FIG. 1, the sewing machine 1 may include a sewing machine bed 11 that may be long in the transverse direction, a pillar 12 that may extend upwardly from a right end part of the sewing machine bed 11, and an arm portion 13 that may extend from a top end of the pillar 12 to the leftward direction in FIG. 1. A left end part of the arm portion 13 is referred to as a head portion 14. In the sewing machine bed 11, there may be provided a needle plate (not shown), a feed dog (not shown), a cloth feed mechanism (not shown), a feed adjustment pulse motor 78 (refer to FIG. 3), and a shuttle mechanism (not shown). The needle plate may be arranged on a top surface of the sewing machine bed 11. The feed dog may be provided under the needle plate, and may feed a work cloth 100 to be sewn by a predetermined feed amount. The cloth feed mechanism may serve as a mechanism for driving the feed dog. The feed adjustment pulse motor 78 may serve as a motor for adjusting the feed amount of the work cloth 100 by means of the feed dog.

An embroidery frame 34 for holding the work cloth 100 may be disposed on the sewing machine bed 11. An area inside an internal circumference 33 of the embroidery frame 34 may serve as an embroidery area in which a stitch of an embroidery pattern may be formed. The embroidery frame 34 may be moved to an arbitrary position that may be based on an XY coordinate system specific to an embroidery frame movement mechanism 92 by means of, for example, the embroidery frame movement mechanism 92. At the time of a stitch forming operation of forming a predetermined stitch or predetermined embroidery pattern on the work cloth 100, an X-axis motor 81 (refer to FIG. 3) and a Y-axis motor 82 (refer to FIG. 3), with which the embroidery frame movement mechanism 92 may be equipped, may be driven, and then, the work cloth 100 may be arbitrarily moved. At the same time, a needle bar 40 and the shuttle mechanism (not shown) may be driven. The XY coordinate system specific to the embroidery frame movement mechanism 92 may herein be regarded as the XY coordinate system specific to the embroidery frame 34. Then, the longitudinal direction of the embroidery frame 34 may be referred to as the Y-axis direction of the XY coordinate system, and the transverse direction of the embroidery frame 34 may be referred to as the X-axis direction of the XY coordinate system.

A liquid crystal display (LCD) 15 formed in an elongated rectangular shape may be provided on a front surface of the pillar 12. On the LCD 15, command names and illustrations for executing a variety of commands used to set or edit a variety of patterns or control sewing may be displayed. In addition, a variety of settings and messages or the like relating to sewing may be displayed on the LCD 15.

On the front surface of the LCD 15, a touch panel 26 may be provided so as to correspond to each of display positions, such as, pattern names of a plurality of patterns or function names for executing a variety of functions, and numeric value settings in a variety of setting screens, for example. The numeric value settings in a variety of setting screens may include a feed amount of the work cloth 160 by means of the feed adjustment pulse motor 78 or a needle swing amount by means of a needle bar swinging pulse motor 80 (refer to FIG. 3). A user may execute selection of patterns to be sewn, instruction of functions, and numeric value setting or the like by, for example, pressing the touch panel 26 corresponding to a pattern display section and a setting section of a screen displayed on the LCD 15 with a finger or a dedicated touch pen (hereinafter, this operation is referred to as a "panel operation").

In addition, a mouse 27 that may be provided independently of a sewing machine body 2 may be connected to the right side of the pillar 12 in FIG. 1. The mouse 27 may serve as a rotational input device equipped with a wheel 28, which may be a plate shaped rotation body. In addition to the mouse 27 may be provided with the wheel 28, a left button 37, a right button 36, and a movement detection section 35 (refer to FIG. 3). At the time of executing normal processing, the mouse 27 may be operable to input an instruction, similar to the touch panel 26, for selecting or setting a variety of items that may be displayed on the LCD 15. In other words, at the time of executing normal processing, the mouse 27 may be operable to move a cursor or a pointer that may be displayed on the LCD 15 in response to, for example, an output signal from the movement detection section 35 (hereinafter, the cursor or pointer is referred to as a "cursor") or the mouse 27 may input an instruction for selecting an item, which may be black-and-white reverse displayed by means of the cursor. On the other hand, at the time of executing a free-motion sewing process for executing free-motion sewing in response to a mouse operation (described later), the mouse 27 may be operable to instruct the movement direction and movement distance (movement amount) of the embroidery frame 34. An operation of the mouse 27, such as, single click, double click, continuous pressing, and dragging of the right button 36 or the left button 37, an operation of rolling the wheel 28 backward or forward, and an operation of moving the mouse 27 is hereinafter referred to as a "mouse operation."

Next, a configuration of an arm portion 13 will be described. A cover 16 to open and close an upper part of the arm portion 13 may be mounted on the arm portion 13. The cover 16 may be provided in the longitudinal direction of the arm portion 13, and may be openably pivoted at the upper rear end part of the arm portion 13 around a transversely oriented shaft. A thread housing portion (not shown) serving as a recessed section for housing a thread spool (not shown) for feeding a thread to the sewing machine 1 may be provided in the vicinity of the upper center of the arm portion 13 under the cover 16. A thread spool pin (not shown) protruding toward a head portion 14, for mounting a thread spool, may be arranged on an internal wall face at the side of the pillar 12 of the thread housing portion. The thread spool may be mounted while an insert hole of the thread spool may be inserted into the thread spool pin. A needle thread (not shown) extending from the thread spool may be supplied to a sewing needle 29 attached to the needle bar 40 (refer to FIG. 2) via a thread hooking section (not shown). The thread hooking section may be provided in the head portion 14, and may include a tensioner (not shown) and a thread take-up spring (not shown) for adjusting thread tension and a thread take-up lever which may reciprocate vertically to take up a needle thread.

At the lower part on the front surface of the arm portion 13, switches, such as a sewing start/stop switch 21, a reverse stitch switch 22, a needle up/down switch 23, a presser foot up/down switch 24, and an automatic threading switch 25, may be provided. The sewing start/stop switch 21 may serve as a switch for starting and stopping operation of the sewing machine 1, for example, to instruct sewing to be started and stopped. The reverse stitch switch 22 may serve as a switch for feeding a work cloth from the rear side to the front side, which may be a reversed direction in comparison with a normal direction. The needle up/down switch 23 may serve as a switch for vertically switching the stop position of the needle bar 40 (refer to FIG. 2). The presser foot up/down switch 24 may serve as a switch for instructing an operation of raising or lowering a presser foot 30. The automatic threading switch 25 may serve as a switch for instructing the start of automatic threading for leading a thread through the thread take-up lever, the tensioner, and the thread take-up spring and finally for threading the sewing needle 29. Further, a speed control lever 32 for adjusting a speed at the time of driving a needle bar 40 in the vertical direction may be provided at the center of the front lower part of the arm portion 13.

Figure 2:
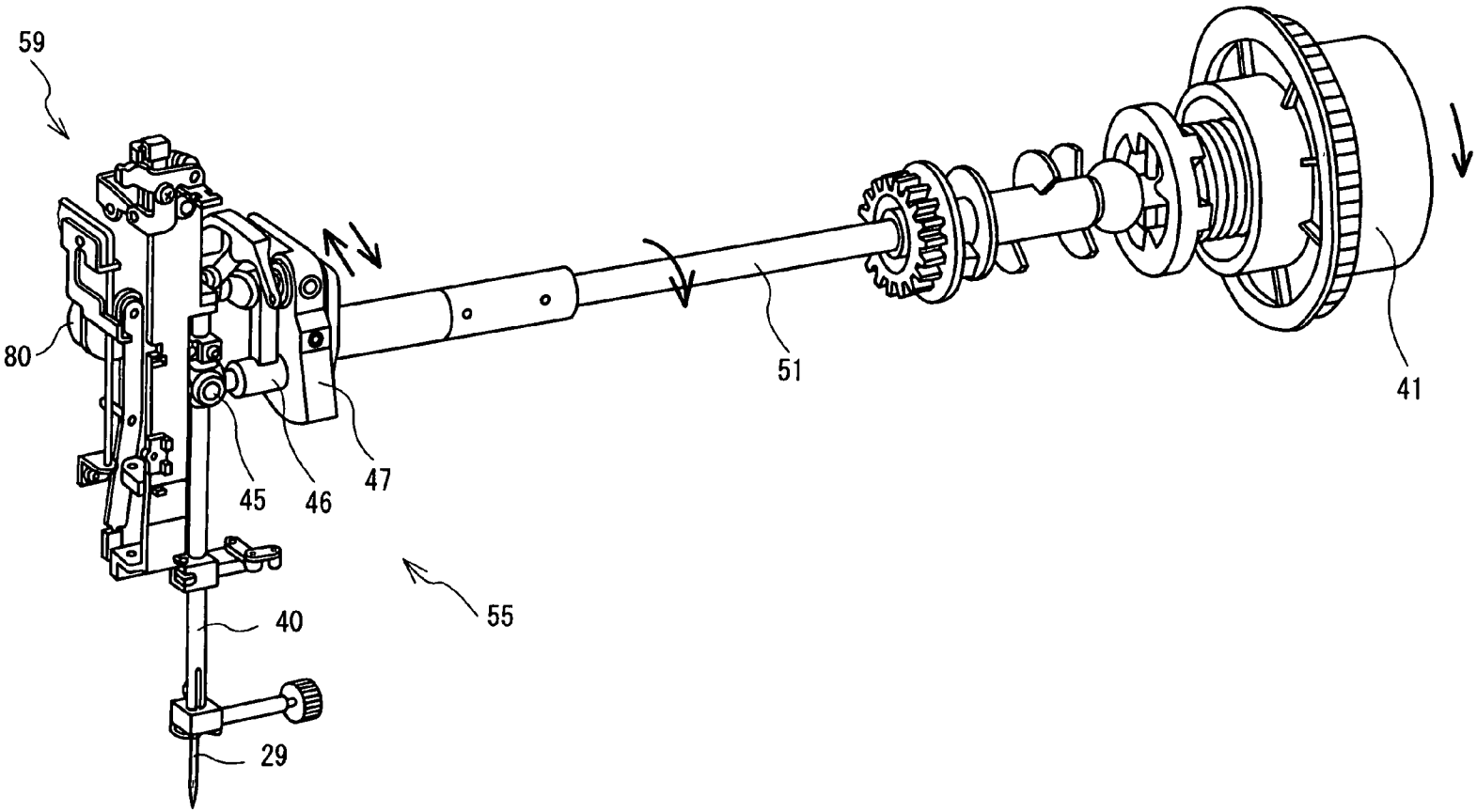
FIG. 2 is a perspective view of a needle bar and a needle bar vertical movement mechanism of a sewing machine.

In addition, at the arm portion 13, as shown in FIG. 2, a drive shaft 51 that may be rotationally driven by means of a sewing machine motor 79 (refer to FIG. 3) may extend in the longitudinal direction of the arm portion 13. A pulley 41 for rotating the drive shaft 51 by means of manual operation may be securely fixed to a right end of the drive shaft 51. At the head portion 14, which may be a left end part of the arm portion 13, a needle bar vertical movement mechanism 55, a needle bar swinging mechanism 59, and a thread take-up mechanism (not shown) may be provided, as shown in FIG. 2. The needle bar vertical movement mechanism 55 may drive the needle bar 40 to which the sewing needle 29 may be attached, in the vertical direction. The needle bar swinging mechanism 59 may swing the needle bar 40 in the transverse direction by using the needle bar swinging pulse motor 80 (refer to FIG. 3) as a source of power. In addition, a presser bar (not shown) may be arranged at the rear side of the needle bar 40. A presser foot 30 (refer to FIG. 1) for pressing the work cloth 100 (refer to FIG. 1) may be attached to the lower end part of the presser bar.

As shown in FIG. 2, the needle bar vertical movement mechanism 55 may include the drive shaft 51, a thread take-up lever crank 47, a needle bar crank rod 46, and a needle bar guide bracket 45. The thread take-up lever crank 47 may be securely fixed to the left tip end part of the bar shaped drive shaft 51 that may extend in the transverse direction, and an end part of the needle bar crank rod 46 may be coupled to the left side surface of the thread take-up lever crank 47 in such a manner that the needle bar crank rod 46 may be rotationally movable with respect to the drive shaft 51. The needle bar guide bracket 45, which may support the needle bar 40, may be coupled to the other end of the needle bar crank rod 46. The needle bar 40 may be vertically moved as follows by means of the needle bar vertical movement mechanism 55 that may be driven by the sewing machine motor 79 shown in FIG. 3 as a drive source. When the drive shaft 51 is rotated by driving the sewing machine motor 79, the rotation of the drive shaft 51 may be transmitted as a vertical motion to the needle bar guide bracket 45 via the thread take-up lever crank 47 and the needle bar crank rod 46. At this time, the needle bar 40 may be vertically moved together with the needle bar guide bracket 45. On the other hand, the needle bar swinging mechanism 59 shown in FIG. 2 may swing the needle bar 40 in the transverse direction by driving an eccentric cam (not shown) that may be rotated by the needle bar swinging pulse motor 80 as a source of power.

Figure 3:
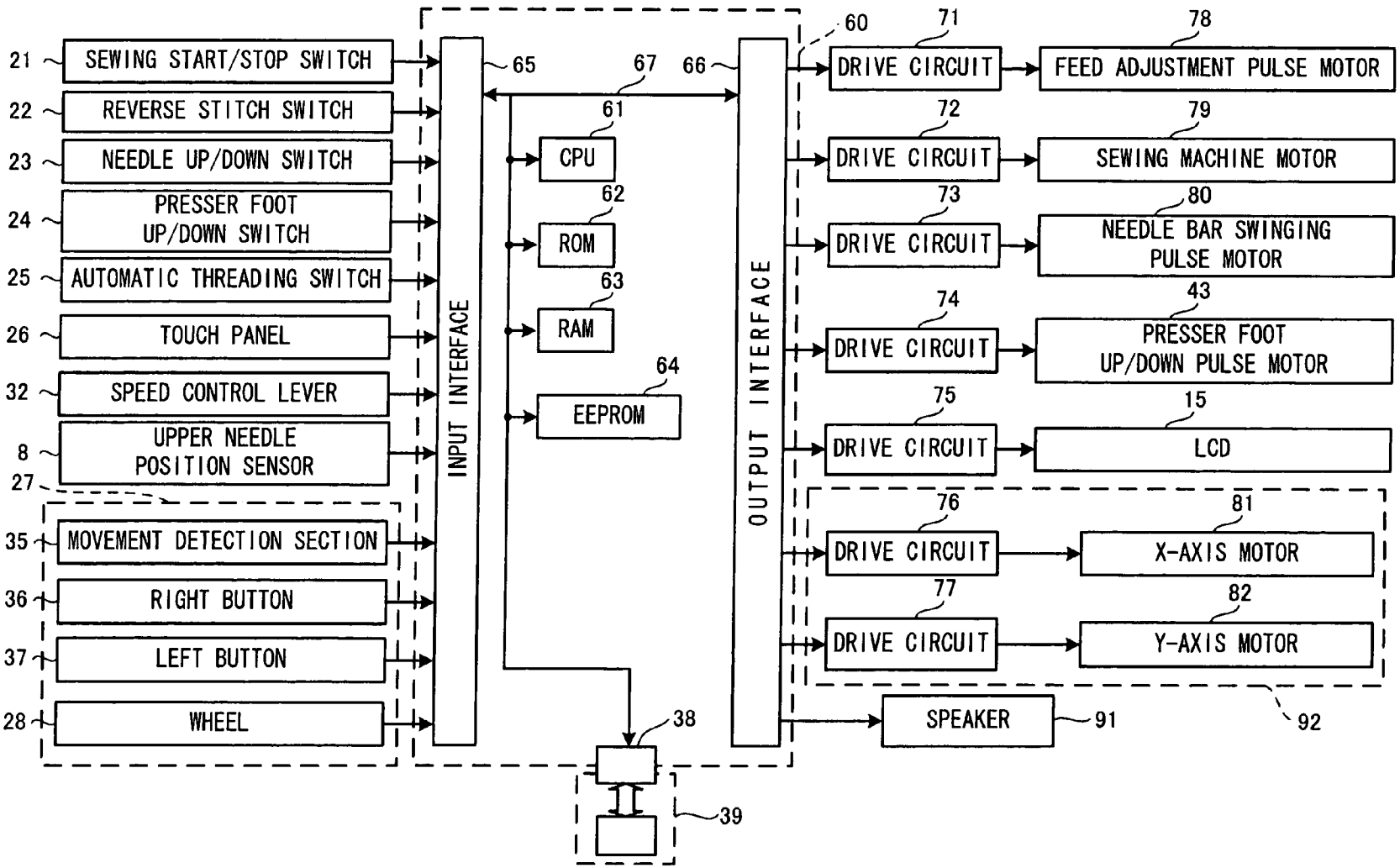
FIG. 3 is a block diagram showing an electrical configuration of a sewing machine.
Figure 4:
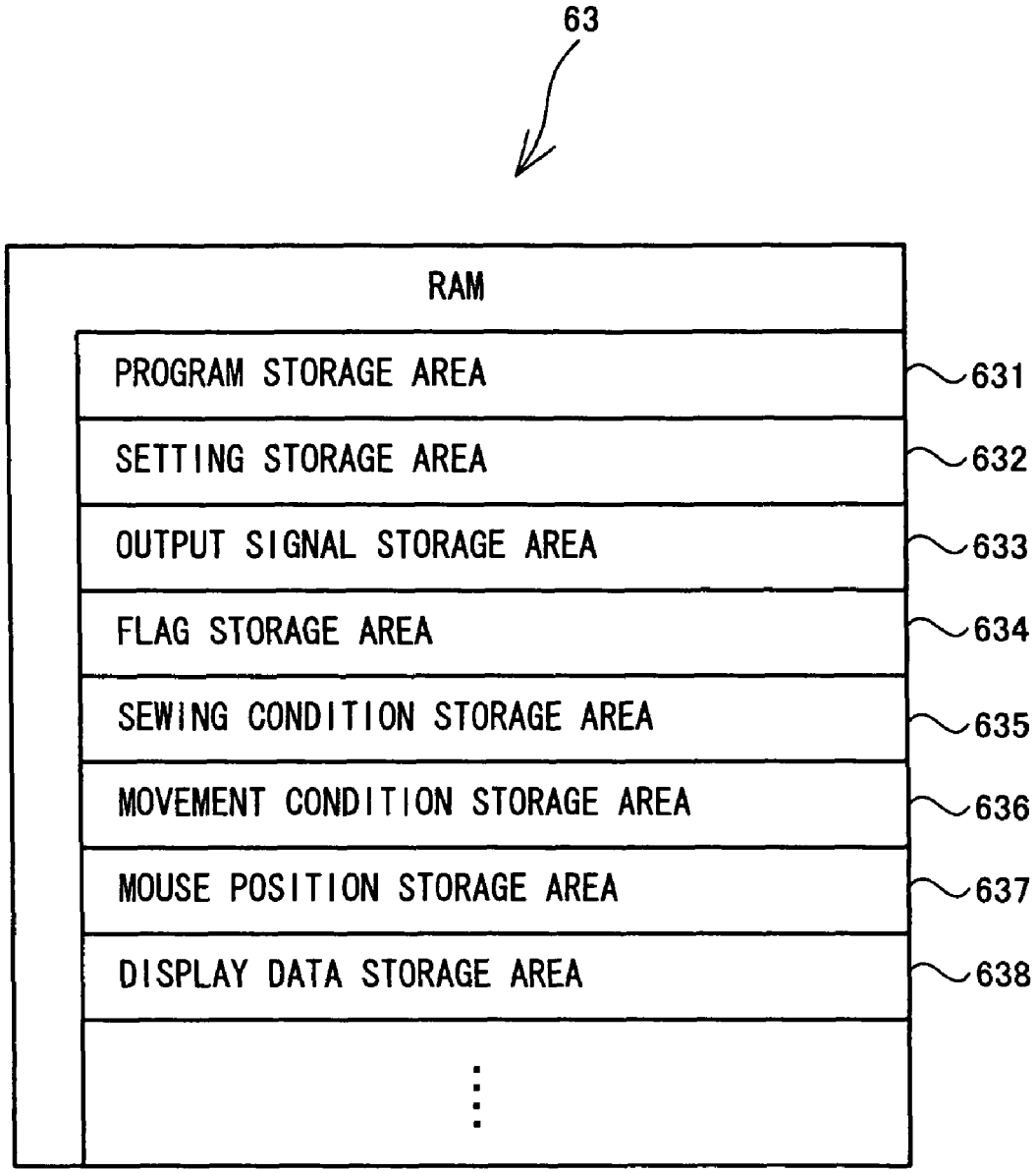
FIG. 4 is a conceptual view of a storage area of a RAM.

Next, an electrical configuration of the sewing machine 1 will be described with reference to FIG. 3 and FIG. 4. As shown in FIG. 3, a control section 60 of the sewing machine 1 may include a CPU 61, a ROM 62, a RAM 63, an EEPROM 64, an input interface 65, an output interface 66, and a connector 38. These elements may be interconnected by means of a bus 67. To the input interface 65, the sewing start/stop switch 21, the reverse stitch switch 22, the needle up/down switch 23, the presser foot up/down switch 24, the automatic threading switch 25, the touch panel 26, and the speed control lever 32, an upper needle position sensor 8 and the mouse 27 may be connected. The mouse 27 may output an output signal that may be based on an operation of any one of operation members, that is, the right button 36, the left button 37, and the wheel 28, and an output signal that may be based on the movement direction and the movement distance (movement amount) of the mouse 27 that may be detected by the movement detection section 35. In addition, the upper needle position sensor 8 may serve as a sensor for monitoring whether the sewing needle 29 (refer to FIG. 1) is above the work cloth 100 (refer to FIG. 1). The upper needle position sensor 8 may be configured to output an ON signal when the sewing needle 29 is above the work cloth 100. To the output interface 66, the feed adjustment pulse motor 78, the sewing machine motor 79, the needle bar swinging pulse motor 80, a presser foot up/down pulse motor 43, the LCD 15, and the X-axis motor 81 and the Y-axis motor 82 may be electrically connected via drive circuits 71 to 77, respectively. The sewing machine motor 79 may serve as a motor for rotationally driving the drive shaft 51 (refer to FIG. 2). The needle bar swinging pulse motor 80 may serve as a motor for swinging the needle bar 40 (refer to FIG. 2). The X-axis motor 81 and the Y-axis motor 82 may serve as motors, with which the embroidery frame movement mechanism 92 may be provided. In addition, a speaker 91 may be connected to the output interface 66. Further, a connector 38 may be configured so that the connector 38 may be interconnected to an external storage device 39. Hereinafter, a detailed description will be given with regard to the CPU 61, the ROM 62, and the RAM 63, which may configure the control section 60 of the sewing machine 1.

The CPU 61 may be responsible for main control of the sewing machine 1, and may execute a variety of computations and processing for executing sewing in accordance with a sewing control program stored in the ROM 62. In addition, the CPU 61 may execute a variety of computations and processing operations in accordance with a sewing machine operation program stored in the ROM 62.

The ROM 62 may have a plurality of storage areas, such as a sewing control program storage area, a sewing machine operation program storage area, and a setting storage area. The sewing control program for carrying out a variety of controls, including drive control of a variety of drive mechanisms, pattern selection control of selecting a variety of patterns, and a variety of display controls, may be stored in the sewing control program storage area. In the sewing machine operation program storage area, the sewing machine operation program may be stored. The sewing machine operation program may be a program for executing free-motion sewing by means of the sewing machine 1 in accordance with the output signal outputted from the mouse 27. A variety of settings to be referred to at the time of executing the sewing machine operation program may be stored in the setting storage area. Part or all of these various programs and settings may be stored in the EEPROM 64 or the data stored in the external storage device 39 may be read in the sewing machine 1.

The RAM 63 may serve as an arbitrarily readable/writable storage device. In the RAM 63, a variety of storage areas may be provided as necessary to store a variety of programs read out from the ROM 62, a variety of settings read out from the EEPROM 64, and a variety of results of computations performed by the CPU 61. A detailed description of the storage areas of the RAM 63 will be given with reference to, for example, FIG. 4. As shown in FIG. 4, the RAM 63 may have a plurality of storage areas such as a program storage area 631, a setting storage area 632, an output signal storage area 633, a flag storage area 634, a sewing condition storage area 635, a movement condition storage area 636, a mouse position storage area 637, and a display data storage area 638. The program storage area 631 may store a variety of programs read out from the ROM 62. The setting storage area 632 may store a variety of settings such as settings and tables, to be referred to at the time of executing the programs read out from the ROM 62. The output signal storage area 633 may store an output signal, which may be outputted from the mouse 27 (refer to FIG. 1 and FIG. 3) and may correspond to an operation state of an operation member of the mouse 27. The flag storage area 634 may store settings of various flags, which may be used during the execution of a variety of programs. The sewing condition storage area 635 may store a sewing condition, which may be specified by a user for executing the free-motion sewing process. The movement condition storage area 636 may store a movement condition for the embroidery frame 34 (FIG. 1) that may be obtained in the free-motion sewing process. The mouse position storage area 637 may store a relative position of the mouse 27 that may be obtained based on the output signal outputted from the mouse 27. The display data storage area 638 may store data for displaying a stitch position indication line and a stitch line on the LCD 15 (refer to FIG. 1 and FIG. 3).

Figure 5:
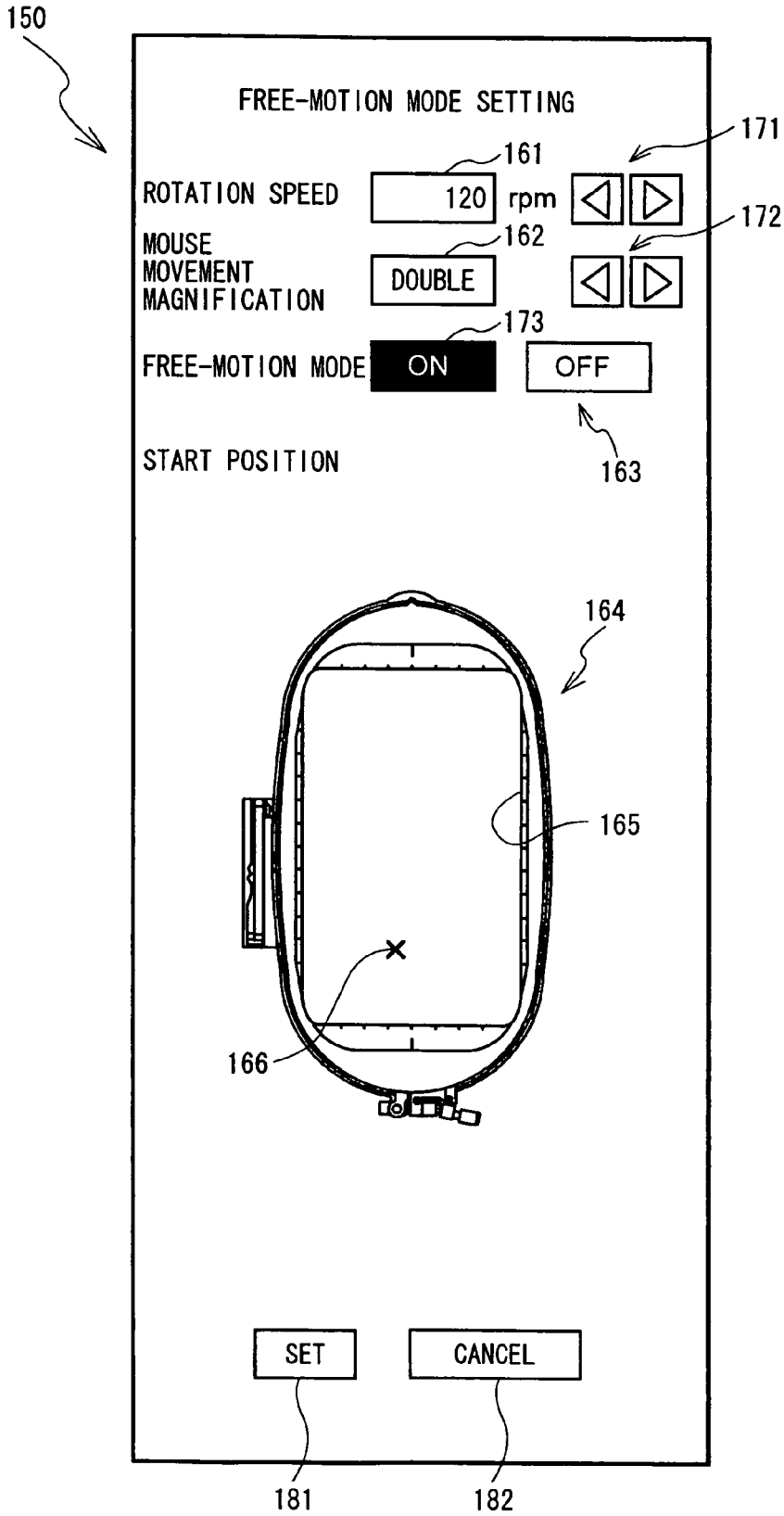
FIG. 5 is an illustrative view of a screen for setting a sewing condition at the time of executing a free-motion sewing process.

Next, with reference to FIGS. 5 to 11, a description will be given with regard to operational procedures when, for example, the free-motion sewing process is carried out with the use of the sewing machine 1 according to the first embodiment. In the free-motion sewing process, free-motion sewing may be executed while the embroidery frame 34 may be moved in accordance with the output signal outputted based on a moving operation of the mouse 27. A description will be given with regard to a specific example. In the specific example, the mouse 27 may be moved so as to draw a hand shape after a sewing condition for executing the free-motion sewing process has been specified on a screen 150, as shown in FIG. 5. The programs for executing processing shown in FIGS. 6 to 8 and FIG. 10 may be stored in the ROM 62. The stored programs may be read into the program storage area 631 of the RAM 63 at the time of program execution, and the read programs may be executed by the CPU 61 shown in FIG. 3. In addition, a variety of information used for the CPU 61 to execute the free-motion sewing process and a free-motion mode displaying process may be read out from the ROM 62, the EEPROM 64, or the external storage device 39, and the read out information may be stored in the setting storage area 632 of the RAM 63.

First, the screen 150 for setting a condition for executing the free-motion sewing process will be described with reference to FIG. 5. On the screen 150, as shown in FIG. 5, a rotation speed field 161, a movement magnification field 162, a free-motion mode setting field 163, and a start position specifying field 164 may be displayed for setting a condition for executing the free-motion sewing process. In the rotation speed field 161, the rotation speed of the drive shaft 51 (refer to FIG. 2) may be set. In the movement magnification field 162, the movement magnification indicative of the movement distance of the embroidery frame 34 relative to the movement distance (movement amount) of the mouse 27 shown in FIG. 1 may be set. A user may select adjustment keys 171 through panel operation or mouse operation, thereby providing the setting of the rotation speed field 161. In addition, the setting of the rotation speed field 161 may be provided by means of the speed control lever 32 disposed on the front surface of the arm portion 13 of the sewing machine 1 shown in FIG. 1. A rotation speed specified by means of the speed control lever 32 may be displayed as a default value of the rotation speed in the rotation speed field 161. The movement magnification field 162 may be provided by way of selecting adjustment keys 172 through panel operation or mouse operation. In addition, in the free-motion mode setting field 163, it may be possible to set whether to execute the free-motion sewing process. When the free-motion mode setting field 163 is set to ON, the free-motion sewing process may be executed. When the free-motion mode setting field 163 is set to OFF, a normal sewing process may be executed without executing the free-motion sewing process. ON/OFF switching of the free-motion mode setting field 163 may be executed by way of moving a cursor 173 through panel operation or mouse operation.

In addition, in the start position specifying field 164, a position of starting free-motion sewing may be specified. An illustration of the embroidery frame 34 may be displayed in the start position specifying field 164. An arbitrary position inside the internal circumference 165 indicated by the illustration of the embroidery frame 34 (refer to FIG. 1) may be specified through the panel operation or the mouse operation, whereby the start position of free-motion sewing may be specified. In the start position specifying field 164, a specified start position 166 is indicated by "X". In addition, a set key 181 and a cancel key 182 may be displayed on the screen 150. The set key 181 may serve as a key for indicating that the free-motion sewing process may be executed. The cancel key 182 may serve as a key for canceling a process for setting a condition for executing the free-motion sewing process, and then, displaying a screen that corresponds to the normal sewing process.

Figure 6:
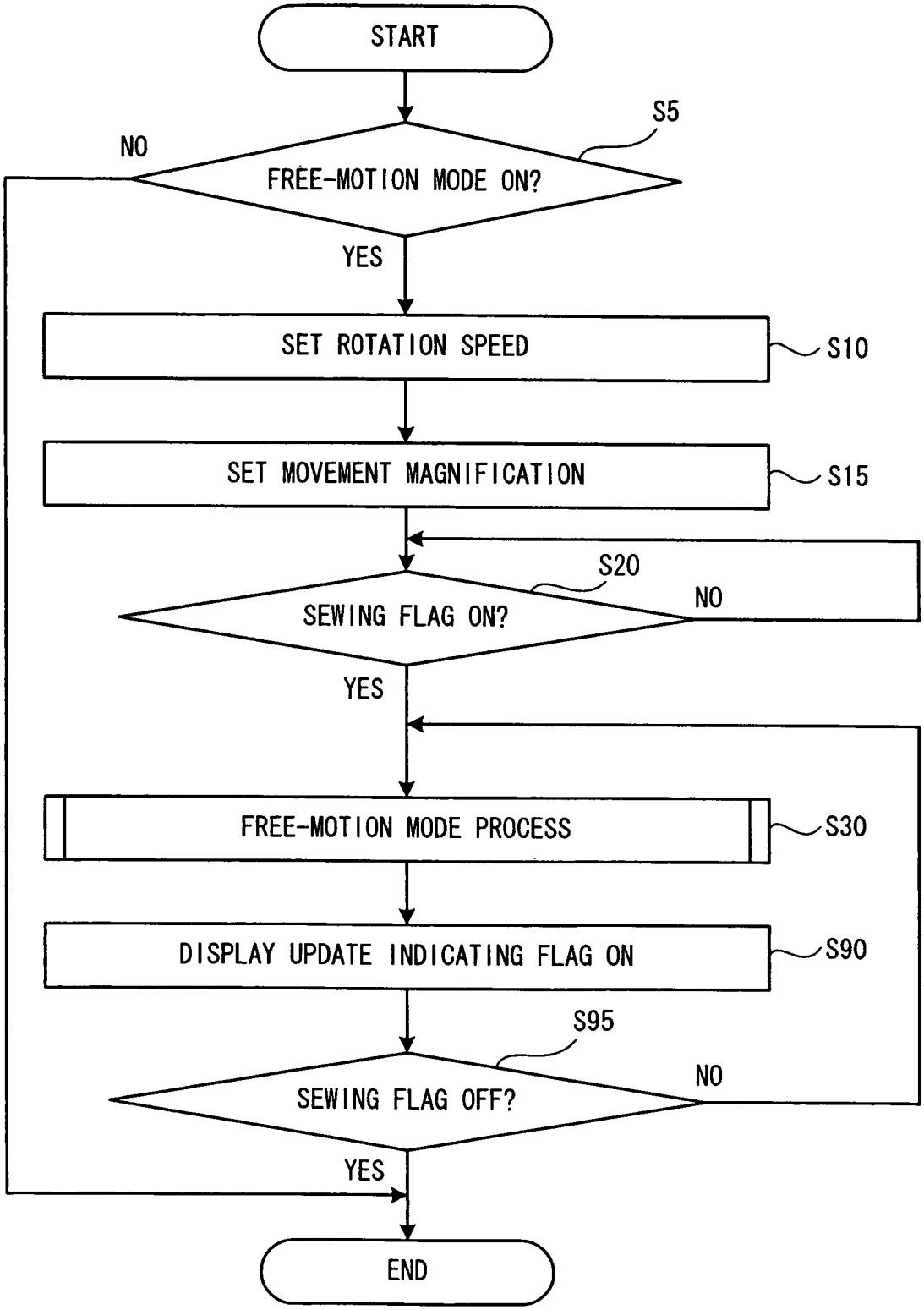
FIG. 6 is a flowchart of a free-motion sewing process.

Next, the free-motion sewing process will be described with reference to, for example, FIG. 6. The free-motion sewing process shown in FIG. 6 may be executed by the CPU 61 when the set key 181 shown in FIG. 5 is selected. The work cloth 100 provided for free-motion sewing is assumed as being held in advance on the embroidery frame 34. In FIG. 6, the CPU 61 may first determine whether the free-motion mode setting field 163 of the screen 150 is set to ON (S5). When the free-motion mode setting field 163 is not set to ON (S5: No), the CPU 61 may terminate the free-motion sewing process. When the free-motion mode setting field 163 is set to ON (S5: Yes), the CPU 61 may store into the sewing condition storage area 635 a rotation speed (for example, 120 rpm) displayed in the rotation speed field 161 of the screen 150 (S10). Subsequently, the CPU 61 may store into the sewing condition storage area 635 a movement magnification (for example, 2× magnification) displayed in the movement magnification field 162 of the screen 150 (S15). The processes of S10 and S15 may serve as processes for setting the sewing condition for executing the free-motion sewing as specified by the user.

Subsequently, the CPU 61 may determine whether a sewing flag is set to ON with reference to the sewing flag that may be stored in the flag storage area 634 (S20). In this process, the CPU 61 may determine whether the user presses the sewing start/stop switch 21 to instruct for starting sewing after the set key 181 shown in FIG. 5 has been selected. In this process, the CPU 61 may determine that the start of sewing has been instructed when the sewing flag is set to ON. With respect to the sewing flag, ON/OFF may be switched every time the user presses the sewing start/stop switch 21. When the sewing flag is set to OFF (S20: No), the CPU 61 may wait until the start of sewing has been instructed, namely, until the sewing flag has been set to ON. When the sewing flag is set to ON (S20: Yes), the CPU 61 may execute a free-motion mode process (S30). In the free-motion mode process, free-motion sewing may be executed such that a stitch may be formed on the work cloth 100 while the embroidery frame 34 may be moved in response to the movement of the mouse 27. A detailed description of the free-motion mode process will be given later with reference to, for example, FIG. 7.

Following the free-motion mode process (S30), the CPU 61 may set a display update indicating flag to ON, and may store the setting into the flag storage area 634 (S90). This process may serve as a process for setting the display update indicating flag to be referenced in a free-motion mode display process, which may be executed separately from the free-motion sewing process. In the free-motion mode display process, a process may be executed for displaying on a display screen a movement trajectory of the mouse 27 and a stitch may be formed by free-motion sewing. A detailed description of the free-motion mode display process will be given later with reference to, for example, FIG. 10. Subsequently, the CPU 61 may determine whether the sewing flag is set to OFF with reference to the sewing flag stored in the flag storage area 634 (S95). When the sewing flag is set to ON (S95: No), the CPU 61 may return to S30 and repeat processing. When the sewing flag is set to OFF (S95: Yes), the CPU 61 may terminate the free-motion sewing process.

By means of the process described above, free-motion sewing may be executed for moving the embroidery frame 34 in response to the movement of the mouse 27. The free-motion mode process executed in S30 of the free-motion sewing process shown in FIG. 6 will be described with reference to, for example, FIG. 7.

In the first embodiment, for the sake of simplification, it may be assumed that a movement output signal indicating a movement direction and a movement distance of the mouse 27 may be outputted every mouse position poling time from the movement detection section 35 of the mouse 27. The mouse position polling time may be predetermined, and may be 1 second in the first embodiment. In addition, a deceleration ratio of rotation speed between the sewing machine motor 79 and the drive shaft 51 may be predetermined. In the sewing machine 1 of the first embodiment, the deceleration ratio may be set to 1/10, for example. In other words, in this example, in the sewing machine 1 of the first embodiment, when a motor shaft of the sewing machine motor 79 rotates 10 times, the drive shaft 51 may rotate once. Further, it may be assumed that the start position of free-motion sewing is the position specified by the user through the screen 150 shown in FIG. 5.

In addition, in the free-motion mode process, based on the output signal outputted from the movement detection section 35, an xy relative coordinate system specific to the mouse 27 may be obtained as a relative position of the mouse 27. The xy relative coordinate system specific to the mouse 27 may assume the x-axis in the transverse direction of the mouse 27 in FIG. 1 (indicated by the arrow 502 in FIG. 1). The side, at which the right button 36 may be provided, is referred to as the positive direction of the x-axis and the side, at which the left button 37 may be provided, is referred to as the negative direction of the x-axis. With respect to a correlation between the movement direction of the mouse 27 and the movement direction of the embroidery frame 34, the x-axis of the mouse 27 may correspond to the X-axis direction of the embroidery frame 34 and the positive direction of the x-axis of the mouse 27 may correspond to the leftward direction of the embroidery frame 34 (hereinafter, referred to as "X-axis negative direction"). Similarly, the y-axis may be assumed in the longitudinal direction of the mouse 27 in FIG. 1 (indicated by the arrow 501 in FIG. 1), and the side, at which the left button 37 and the right button 36 may be provided, is referred to as the positive direction of the y-axis. In addition, it may be assumed that the y-axis of the mouse 27 may correspond to the Y-axis direction of the embroidery frame 34, and the positive direction of the y-axis of the mouse 27 may correspond to the front direction of the embroidery frame 34 (hereinafter, referred to as "Y-axis negative direction").

When the mouse 27 may be moved in the x-axis positive direction in the xy relative coordinate system specific to the mouse 27, the embroidery frame 34 may be moved in the X-axis negative direction in the XY coordinate system of the embroidery frame 34. In other words, plus/minus of each axis representing the movement direction of the mouse 27 in the xy relative coordinate system of the mouse 27 may be reversed from plus/minus of each axis representing the movement direction of the embroidery frame 34 in the XY coordinate system of the embroidery frame 34. This is because the embroidery frame 34 may be moved so that the relative movement direction of the needle bar 40 (refer to FIG. 2) with respect to the embroidery frame 34 (the work cloth 100) may be identical to that of the mouse 27. A variety of settings for the CPU 61 to execute the free-motion mode process may be stored in the ROM 62, and may be read in the setting storage area 632 of the RAM 63 at the time of program execution.

Figure 7:
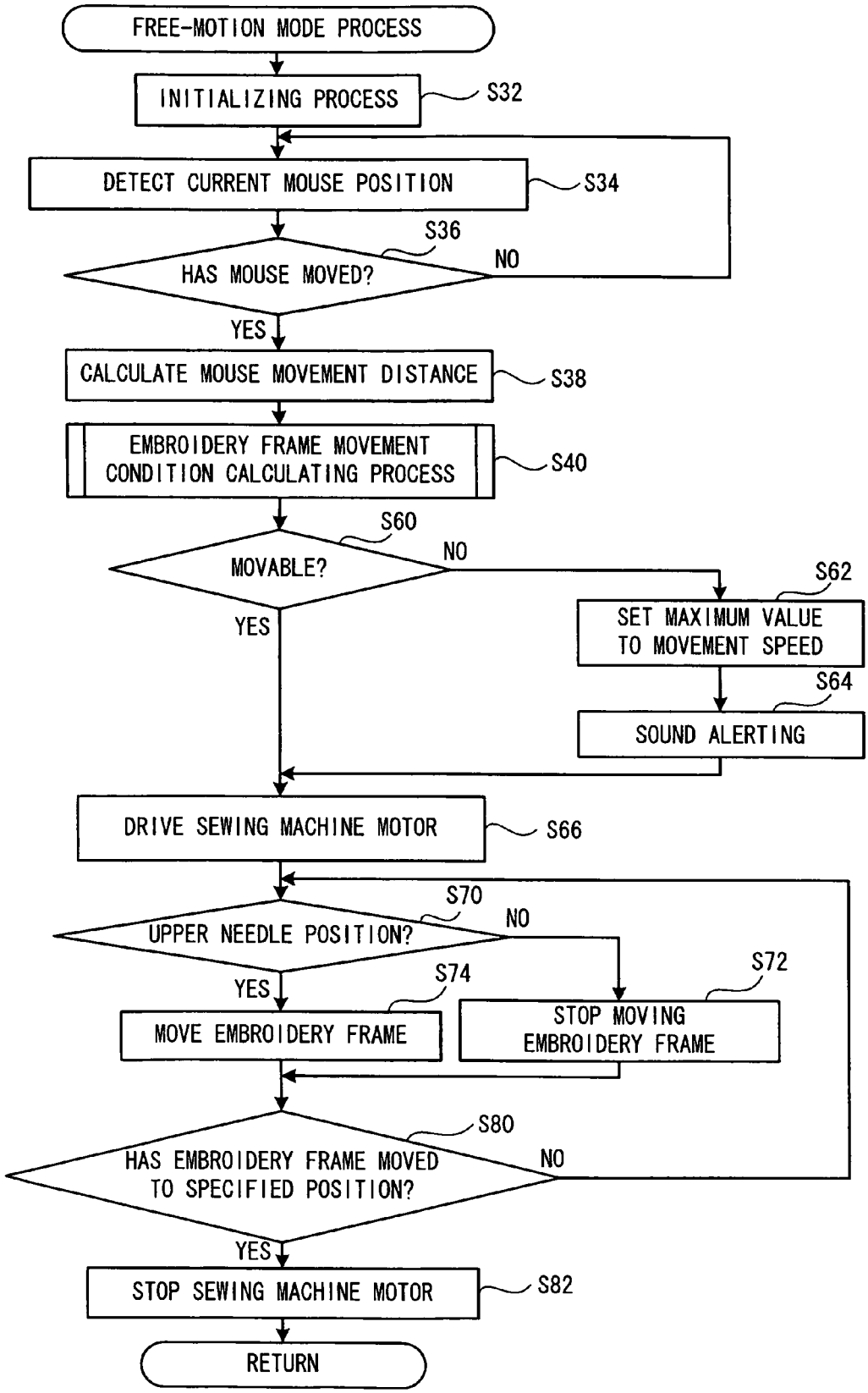
FIG. 7 is a flowchart of a free-motion mode process executed in the free-motion sewing process of FIG. 6.

As shown in FIG. 7, in the free-motion mode process, the CPU 61 may first execute an initializing process (S32). In this process, for example, the CPU 61 may delete information that may be stored in the mouse position storage area 637. In addition, the CPU 61 may set an origin for obtaining a relative position of the mouse 27, and may store the setting into the mouse position storage area 637. Further, the CPU 61 may instruct the drive circuits 76 and 77 to move the embroidery frame 34 to a position where a positional relationship between the needle bar 40 and the embroidery frame 34 is the same as the relationship specified through the screen 150 of FIG. 5. Subsequently, the CPU 61 may detect a current position of the mouse 27 based on, for example, an output signal outputted from the movement detection section 35 of the mouse 27, with reference to the output signal storage area 633. Then, the CPU 61 may store the current position of the mouse 27 into the mouse position storage area 637 together with a sequential order of acquiring the output signal (S34). As described previously, the movement detection section 35 of the mouse 27 may output an output signal including information relating to the movement direction and the movement distance (movement amount) of the mouse 27 at each mouse position polling time. In the first embodiment, the output signals that may be outputted at each mouse position polling time from the mouse 27 may be sequentially acquired in a process executed separately. Then, each of the output signals may be stored in the output signal storage area 633 together with the acquisition sequential order. In the free-motion mode process, the CPU 61 may obtain a mouse position with reference to the output signal that may be stored in the output signal storage area 633.

Subsequently, the CPU 61 may compare a current mouse position with a previous mouse position with reference to the mouse position storage area 637, and then, may determine whether the mouse 27 has moved (S36). The current mouse position may denote a position of the mouse 27 that is newly acquired in S34. The previous mouse position denotes a position of the mouse 27, which may be acquired in S34 of the previously executed the free-motion mode process. When the current mouse position and the previous mouse position have the same relative coordinate (S36: No), the mouse 27 may not have moved. Therefore, the CPU 61 may return to S34, and then, may repeat processing. When the current mouse position and the previous mouse position have different relative coordinates (S36: Yes), the mouse 27 may have moved. Therefore, the CPU 61 may calculate the movement distance (movement amount) of the mouse 27 from the current mouse position and the previous mouse position, with reference to the mouse position storage area 637. Then the CPU 61 may store the calculation result into the mouse position storage area 637 (S38). In the specific example, when the current mouse position represented by a relative coordinate (x, y) is (10 cm, 8 cm) and the previous mouse position is (9.5 cm, 8 cm), the movement distance of the mouse 27 is 0.5 cm. Subsequently, the CPU 61 may execute an embroidery frame movement condition calculating process (S40). In the embroidery frame movement condition calculating process, the movement distance (movement amount), the movement direction, and the movement speed of the embroidery frame 34 may be calculated.

Figure 8:
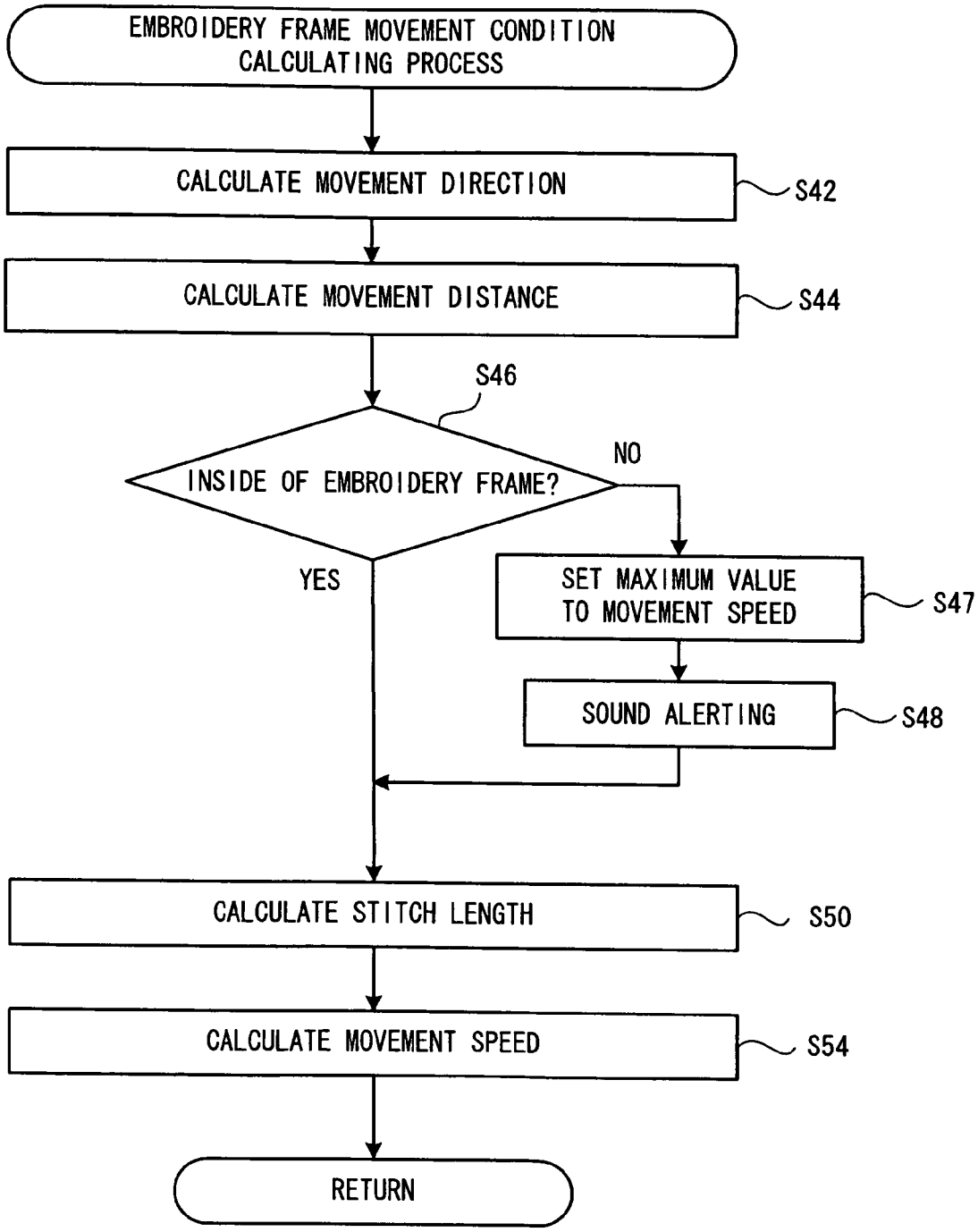
FIG. 8 is a flowchart of an embroidery frame movement condition calculating process, executed in the free-motion mode process shown in FIG. 7.

The embroidery frame movement condition calculating process will be described with reference to, for example, FIG. 8. The calculation result of the embroidery frame movement condition calculating process may be referenced in the free-motion mode display process described later with reference to, for example, FIG. 10. Therefore, in the embroidery frame movement condition calculating process, the CPU 61 may store the calculation results sequentially into the condition storage area 636 together with the movement sequential order of the embroidery frame 34. As shown in FIG. 8, the CPU 61 may first calculate the movement direction of the embroidery frame 34 with the use of the current mouse position and the previous mouse position, with reference to the mouse position storage area 637. Then, the CPU 61 may store the calculation result into the movement condition storage area 636 (S42). In the specific example, from the fact that the current mouse position is (10 cm, 8 cm) and the previous mouse position is (9.5 cm, 8 cm), the X-axis negative direction (leftward direction) may be obtained as a movement direction of the embroidery frame 34.

Subsequently, the CPU 61 may calculate a movement distance of the embroidery frame 34, with reference to the mouse position storage area 637 and the sewing condition storage area 635. Then, the CPU 61 may store the calculation result into the movement condition storage area 636 (S44). The movement distance of the embroidery frame 34 may be calculated from the current mouse position, the previous mouse position, and the movement magnification set in S15 of FIG. 6 using an equation, for example, {(current mouse position)−(previous mouse position)}*(movement magnification). In the specific example, the CPU 61 obtains 1 cm as a movement distance of the embroidery frame 34 from {(10 cm, 8 cm)−(9.5 cm, 8 cm)}*2. Then, the CPU 61 may store 1 cm into the movement condition storage area 636 (S44) as the movement distance of the embroidery frame 34.

Subsequently, with reference to the movement condition storage area 636, the CPU 61 may obtain a needle drop point (stitch point) when the embroidery frame 34 is moved from the current position by the movement distance obtained in S44 in the direction obtained in S42. Then, the CPU 61 may determine whether the needle drop point is inside of the embroidery frame 34 (S46). In this process, the CPU 61 may determine whether the embroidery frame 34 may be moved by a distance and in a direction corresponding to the movement of the mouse 27. The inside of the embroidery frame 34 may denote an area inside of the internal circumference 33 of the embroidery frame 34. When the needle drop point after the movement is not inside the embroidery frame 34 (S46: NO), the CPU 61 may set the movement distance of the embroidery frame 34, which may have been set in S44, at a maximum distance such that the needle drop point after the movement may be inside the embroidery frame 34. Then, the CPU 61 may store the setting into the movement condition storage area 636 (S47). Subsequently, the CPU 61 may sound an alert by means of a speaker 91 (S48). This process may serve as a process for announcing to a user that the embroidery frame 34 cannot be moved to a position according to the movement of the mouse 27.

When the needle drop point after the movement is inside of the embroidery frame 34 (S46: Yes) or following S48, the CPU 61 may reference the movement condition storage area 636, the sewing condition storage area 635, and the setting storage area 632. Then, the CPU 61 may calculate the movement distance of the embroidery frame 34 per one needle stroke (stitch length), and then, may store the calculation result into the movement condition storage area 636 (S50). The movement distance of the embroidery frame 34 per one needle stroke may be calculated from a number of stitches to be formed per mouse position polling time and the movement distance of the embroidery frame 34. The number of stitches to be formed per mouse position polling time may be calculated from the mouse position polling time and the rotation speed of the drive shaft 51. The movement distance of the embroidery frame 34 may be stored in the movement condition storage area 636. In the specific example, the CPU 61 may obtain 2 as the number of stitches to be formed from (mouse position polling time (1 second))*(rotation speed of the drive shaft 51 (120 rpm)). Subsequently, the CPU 61 may obtain 0.5 cm as the movement distance of the embroidery frame 34 per one needle stroke from (movement distance obtained in S44 (1 cm))/(the number of stitches to be formed (2)). When the number of stitches to be formed is not an integer, the CPU 61 may truncate a fractional portion.

Subsequently, the CPU 61 may calculate the movement speed of the embroidery frame 34, and then, may store the calculation result into the movement condition storage area 636 (S54). The movement speed of the embroidery frame 34 may be calculated by (movement distance of the embroidery frame 34 per one needle stroke)/(movable time of the embroidery frame 34 per one needle stroke). The CPU 61 may read out the movable time of the embroidery frame 34 per one needle stroke corresponding to the rotation speed of the drive shaft 51 that may be set in S10 of the FIG. 6 with reference to the setting storage area 632 of the RAM 63. A relationship between the rotation speed of the drive shaft 51 and the movable time of the embroidery frame 34 per one needle stroke may be stored in the setting storage area 632. In the specific example, the movable time of the embroidery frame 34 per one needle stroke corresponding to a case in which the rotation speed of the drive shaft 51 is 120 rpm is stored to be 0.2 second in the setting storage area 632. Therefore, in the specific example, the CPU 61 may obtain the movement speed 2.5 (cm/second) of the embroidery frame 34 from (movement distance of the embroidery frame 34 per one needle stroke (0.5 cm))/(movable time of the embroidery frame 34 per one needle stroke (0.2 seconds)). Then, the CPU 61 may store the movement speed 2.5 (cm/second) of the embroidery frame 34 into the movement condition storage area 636 (S54). Subsequently, the CPU 61 may terminate the embroidery frame movement condition calculating process shown in FIG. 8, and then, may return to the free-motion mode process shown in FIG. 7.

The free-motion mode process will be described with reference to, for example, FIG. 7. Following S40, with reference to the setting storage area 632 and the movement condition storage area 636, the CPU 61 may determine whether the movement speed of the embroidery frame 34 set in S54 of FIG. 8 is greater than a maximum value defining an upper limit of the movement speed of the embroidery frame 34 (S60). In this process, the CPU 61 may determine whether the embroidery frame 34 may be moved at the movement speed corresponding to the movement distance (movement amount) of the mouse 27, i.e., whether the movement of the embroidery frame 34 may follow the movement distance of the mouse 27. In the sewing machine 1 of the first embodiment, the maximum value of the movement speed of the embroidery frame 34 may be predetermined, and the embroidery frame 34 should not be moved at a movement speed that exceeds the maximum value. Thus, when the calculated movement speed of the embroidery frame 34 exceeds the maximum value (S60: No), the CPU 61 may store the maximum value of the movement speed as a movement speed of the embroidery frame 34 into the movement condition storage area 636 (S62). Subsequently, the CPU 61 may sound an alert by the speaker 91 (S64). In this process, the CPU 61 may announce to a user that the movement of the embroidery frame 34 cannot follow the movement distance of the mouse 27. According to this alert, a user may know that the movement speed of the mouse 27 may be too fast. Then, the user having received the announcement may take action to reduce the movement speed of the mouse 27 or to reset the movement magnification.

When the movement speed of the embroidery frame 34 does not exceed the maximum value (S60: Yes) and following S64, the CPU 61 may instruct a drive circuit 72 (refer to FIG. 3) to drive a sewing machine motor 79 (refer to FIG. 2) to start sewing (S66). The CPU 61 may control the rotation speed of the sewing machine motor 79 so that the rotation speed of the drive shaft 51 may equal the rotation speed set in S10 of FIG. 6. The sewing machine motor 79 may be driven until it has been stopped in S82, which is described later. Subsequently, the CPU 61 may determine whether the vertical position of the sewing needle 29 is above the work cloth 100 based on an output signal from the upper needle position sensor 8 (S70). In this process, the CPU 61 may determine whether the embroidery frame 34 may be moved. This process may prevent breakage of the sewing needle 29 caused by movement of the embroidery frame 34 where the sewing needle 29 may be beneath the work cloth 100 (e.g., where the sewing needle 29 may penetrate the work cloth 100). When the vertical position of the sewing needle 29 is above the work cloth 100 (S70: Yes), the CPU 61 may instruct the drive circuits 76 and 77 to respectively drive an X-axis motor 81 and a Y-axis motor 82 to move the embroidery frame 34 (S74). In this process, the CPU 61 may move the embroidery frame 34 during the movable time at the movement speed calculated in S54 in the movement direction calculated in S42 of FIG. 8 with reference to the movement condition storage area 636. In the specific example, the CPU 61 may move the embroidery frame 34 at the movement speed of 2.5 (cm/second) during the movable time of 0.2 seconds in the negative direction of the X-axis. As a result, the embroidery frame 34 may be moved by 0.5 cm towards the negative direction of the X-axis. When the vertical position of the sewing needle 29 is not above the work cloth 100 (S70: No), the CPU 61 may instruct the drive circuits 76 and 77 to stop the embroidery frame 34 (S72).

Following S72 or S74, the CPU 61 may determine whether the embroidery frame 34 has been moved to a specified position, and a stitch has been formed, with reference to the sewing condition storage area 635 and the movement condition storage area 636 (S80). The specified position used here may denote a position to which the embroidery frame 34 may be moved by the movement distance obtained in S44 of FIG. 8 in the movement direction obtained in S42 of FIG. 8 from the current position of the embroidery frame 34 obtained in S34. The CPU 61 may determine whether the embroidery frame 34 has been moved to the specified position and whether a stitch has been formed in accordance with the a number of stitches to be formed as obtained in S50, for example. When the embroidery frame 34 has not been moved to the specified position (S80: No), the CPU 61 may return to S70, and then, may repeat processing. When the embroidery frame 34 has been moved to the specified position (S80: Yes), the CPU 61 may instruct the drive circuit 72 to stop rotational driving of the sewing machine motor 79 (S82). Subsequently, the CPU 61 may terminate the free-motion mode process shown in FIG. 7, and then, may return to the free-motion sewing process shown in FIG. 6.

Figure 9:
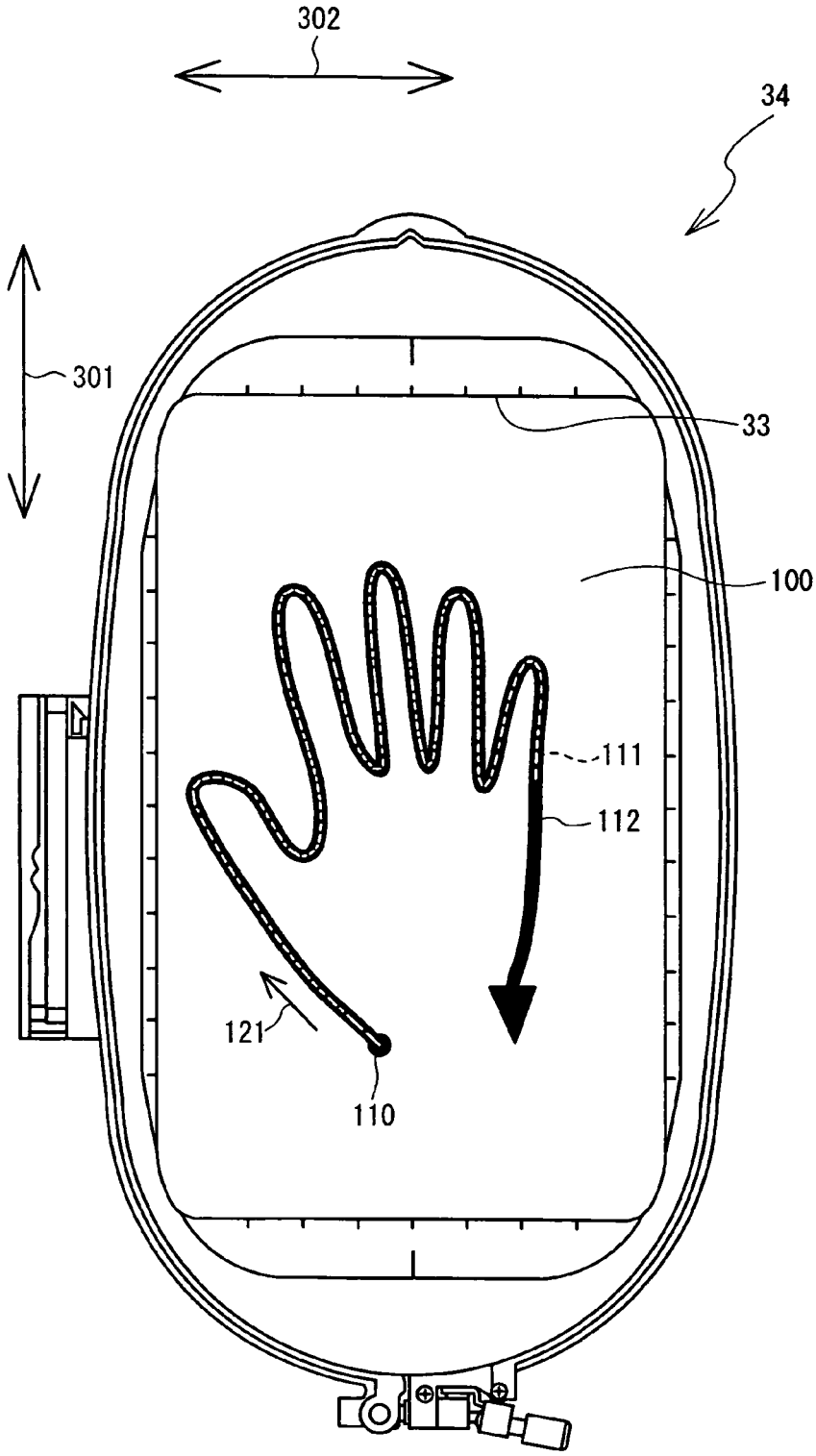
FIG. 9 is an illustrative view of stitches formed in a free-motion sewing process.

By the free-motion sewing process described in detail above, free-motion sewing may be executed, in which the embroidery frame 34 may be moved based on output signals corresponding to the movement of the mouse 27, and the stitches may be formed. In the free-motion sewing process, in the specific example, in which a user operates the mouse 27 so as to draw the shape of a hand, a stitch line 111 as shown in FIG. 9 may be formed on the work cloth 100. In FIG. 9, the X-axis direction of the embroidery frame 34 (indicated by the arrow 302) may correspond to the x-axis direction of the mouse 27, and the Y-axis direction of the embroidery frame 34 (indicated by the arrow 301) may correspond to the y-axis direction of the mouse 27. In FIG. 9, a stitch position indication line 112 indicated by the solid line may denote a virtual line specified by operation of the mouse 27, on which stitches may be formed. The stitch position indication line 112 may be obtained by multiplying the movement trajectory of the mouse 27 by the movement magnification. The arrow indicated at the right tip end of the stitch position indication line 112 may indicate the movement direction of the mouse 27. As shown in FIG. 9, the stitch line 111 may be formed based on output signals from the mouse 27 so as to overlap with the stitch position indication line 112 formed in the direction indicated by an arrow 121 from a start position 110. In FIG. 9, the right end portion of the stitch position indication line 112, which does not overlap with the stitch line 111, may indicate a portion at which no sewing has been carried out by the free-motion sewing process yet. The stitch length of the stitch line 111 may reflect the movement speed of the mouse 27. Because the movement distance obtained in S44 of FIG. 8 becomes longer as the movement speed of the mouse 27 becomes faster, the stitch length of the stitches formed in the work cloth 100 may increase.

Next, the free-motion mode display process will be described with reference to FIG. 10. In the free-motion mode display process shown in FIG. 10, a stitch position indication line and a stitch line may be displayed on the LCD 15. The stitch position indication line represents positions specified by the mouse 27 at which stitches of free-motion sewing may be formed. The stitch line may indicate positions of the stitches actually formed in the free-motion sewing process. The free-motion mode display process may be executed separately from the free-motion sewing process shown in FIG. 6 when the set key 181 may have been selected when the free-motion mode setting field 163 shown in FIG. 5 is set to ON.

Figure 10:
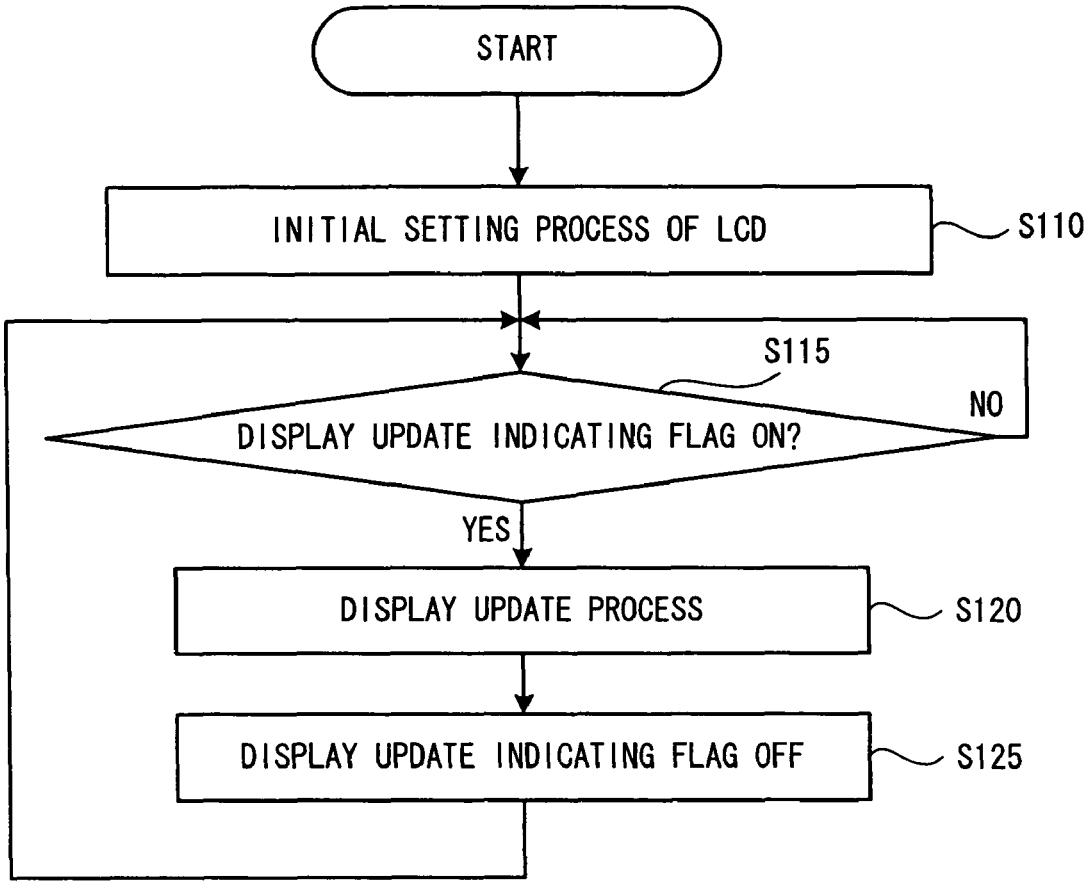
FIG. 10 is a flowchart of a free-motion mode display process.

In FIG. 10, first, the CPU 61 may execute an initial setting process of the LCD 15 of the sewing machine 1 (S110). In this process, for example, the CPU 61 may read out a special screen for the free-motion mode process from the setting storage area 632, and then, may display the screen on the LCD 15 (S110).

Subsequently, the CPU 61 may determine whether the display update indicating flag is set to ON with reference to the flag storage area 634 (S115). The display update indicating flag may be used for updating and displaying the screen on the LCD 15. The display update indicating flag may be set to ON in S90 of FIG. 6, and then, may be set to OFF in S125 described later. When the display update indicating flag is not set to ON (S115: No), the CPU 61 may wait until the display update indicating flag has been set to ON. When the display update indicating flag is set to ON (S115: Yes), the CPU 61 may execute a display updating process for updating the screen displayed on the LCD 15 (S120).

In the display updating process, the CPU 61 may cause the LCD 15 to display a screen representing a stitch position indication line and a stitch line. For example, in the specific example, when a stitch line 111 shown in FIG. 9 may be formed based on output signals from the mouse 27, a screen 200 shown in FIG. 11 may be displayed. A longitudinal direction of the screen 200 (indicated by an arrow 401 in FIG. 11) may correspond to the Y-axis direction of the embroidery frame 34, and a transverse direction of the screen 200 (indicated by an arrow 402 in FIG. 11) may correspond to the X-axis direction of the embroidery frame 34. In addition, a stitch position indication line 212 shown in the screen 200 may correspond to a stitch position indication line 112 shown in FIG. 9, and a stitch line 211 may correspond to the stitch line 111 shown in FIG. 9.

In the display updating process, a process for displaying the stitch line 211 and the stitch position indication line 212 may be executed as follows, for example. As a process for obtaining the stitch position indication line 212, first, the CPU 61 may obtain the shape of the stitch position indication line 112 by multiplying the movement trajectory of the mouse 27 by the movement magnification with reference to the sewing condition storage area 635 and the mouse position storage area 637. Subsequently, the CPU 61 may generate image data representing the stitch position indication line 212 to be displayed on the screen from the shape of the stitch position indication line 112. Furthermore, with reference to the movement condition storage area 636, the CPU 61 may obtain the XY coordinate of needle drop points for each of stitches which may be formed by free-motion sewing at the time point of executing S120, and then, the CPU 61 may find the coordinates of the stitch line 211. Subsequently, the CPU 61 may generate image data representing the stitch line 211 to be displayed on the screen from the coordinates of the stitch line 211. Then, the CPU 61 may cause the LCD 15 to display the image data representing the stitch position indication line 212 and the stitch line 211, respectively.

Following S120, the CPU 61 may set the display update indicating flag to OFF, and may store the setting into the flag storage area 634 (S125). Subsequently, the CPU 61 may return to S115, and then, may repeat processing. As described above in detail, the free-motion sewing process and the free-motion mode display process of the first embodiment may be executed.

According to the sewing machine 1 of the first embodiment described above in detail, the CPU 61 may move the embroidery frame 34 based on an output signal corresponding to the movement direction and the movement distance (movement amount) of the mouse 27 and may thereby execute free-motion sewing. Therefore, a user may execute free-motion sewing with simple operation without directly moving the work cloth 100. Thus, even a user unfamiliar with free-motion sewing may move the work cloth 100 to a desired position, and may form a desired stitch by free-motion sewing. In addition, because the mouse 27 may be provided independently of the sewing machine body 2, the user may be able to place the mouse at an easily operable position and may easily operate it to indicate the positions of stitches to be formed on the work cloth 100.

In addition, the CPU 61 may control the rotation speed of the sewing machine motor 79 at the time of executing free-motion sewing so as to be equal to that of the drive shaft 51 that the user has preset. Therefore, the user may execute free-motion sewing without adjusting the rotation speed of the sewing machine motor 79 during sewing.

In addition, in the sewing machine 1 of the first embodiment, a correlation between the output signal from the mouse 27 and the movement distance (movement amount) of the embroidery frame 34 may be set as a movement magnification by operating a mouse or panel. For example, when sewing a large stitch pattern by free-motion sewing, the movement magnification may preferably be set to high. In this case, the user may input an instruction for increasing the movement distance of the embroidery frame 34 even if the movement distance (movement amount) of the mouse 27 may be small, in comparison with the case in which the movement magnification may be low. Thus, the movement distance for moving the mouse 27 may be reduced, operation may be facilitated, and a space for moving the mouse 27 may be reduced. In addition, for example, when sewing a stitch pattern having a finely complicated shape by free-motion sewing, the movement magnification may preferably be set to low. In this case, the user may easily output an instruction for sewing a finely complicated shape by significantly moving the mouse 27 because the movement distance of the embroidery frame 34 may be reduced with respect to the movement distance of the mouse 27. In this way, by properly setting the movement magnification, operability of the mouse 27 to indicate the movement distance of the embroidery frame 34 may be improved.

In addition, in the free-motion mode display process shown in FIG. 10, the CPU 61 may calculate the movement trajectory of the embroidery frame 34 that may correspond to the output signals outputted from the mouse 27, and then, may cause the LCD 15 to display the movement trajectory as the stitch line 211. Thus, the user may carry out free-motion sewing while checking the stitch line formed by way of operating the mouse 27. For example, when sewing is carried out with the thread whose color may be identical to that of the work cloth or in the case where the stitch formed by free-motion sewing may be difficult to visualize due to the color pattern of the work cloth, operability may be improved.

In the meantime, in the first embodiment, at the time of free-motion sewing, the CPU 61 may execute free-motion sewing while driving the sewing machine motor 79 so that the rotation speed of the drive shaft 51 may be equal to the rotation speed specified by the user. According to this method, there may be an advantage that a stitch may be formed at a constant pace, whereas the stitch length of a stitch formed by the free-motion sewing process may not be constant because the stitch lengths may vary depending on the movement speed of the mouse 27.

In order to keep the stitch lengths constant, processing may be carried out as in a second embodiment, which is described later. Hereinafter, with reference to, for example, FIGS. 12 to 16, a description will be given with regard to the second embodiment in which the free-motion sewing process may be executed by operating the mouse 27 with the use of the sewing machine 1 of the second embodiment, having a physical configuration and an electrical configuration that may be similar to those of the sewing machine 1 of the first embodiment.

Figure 13:
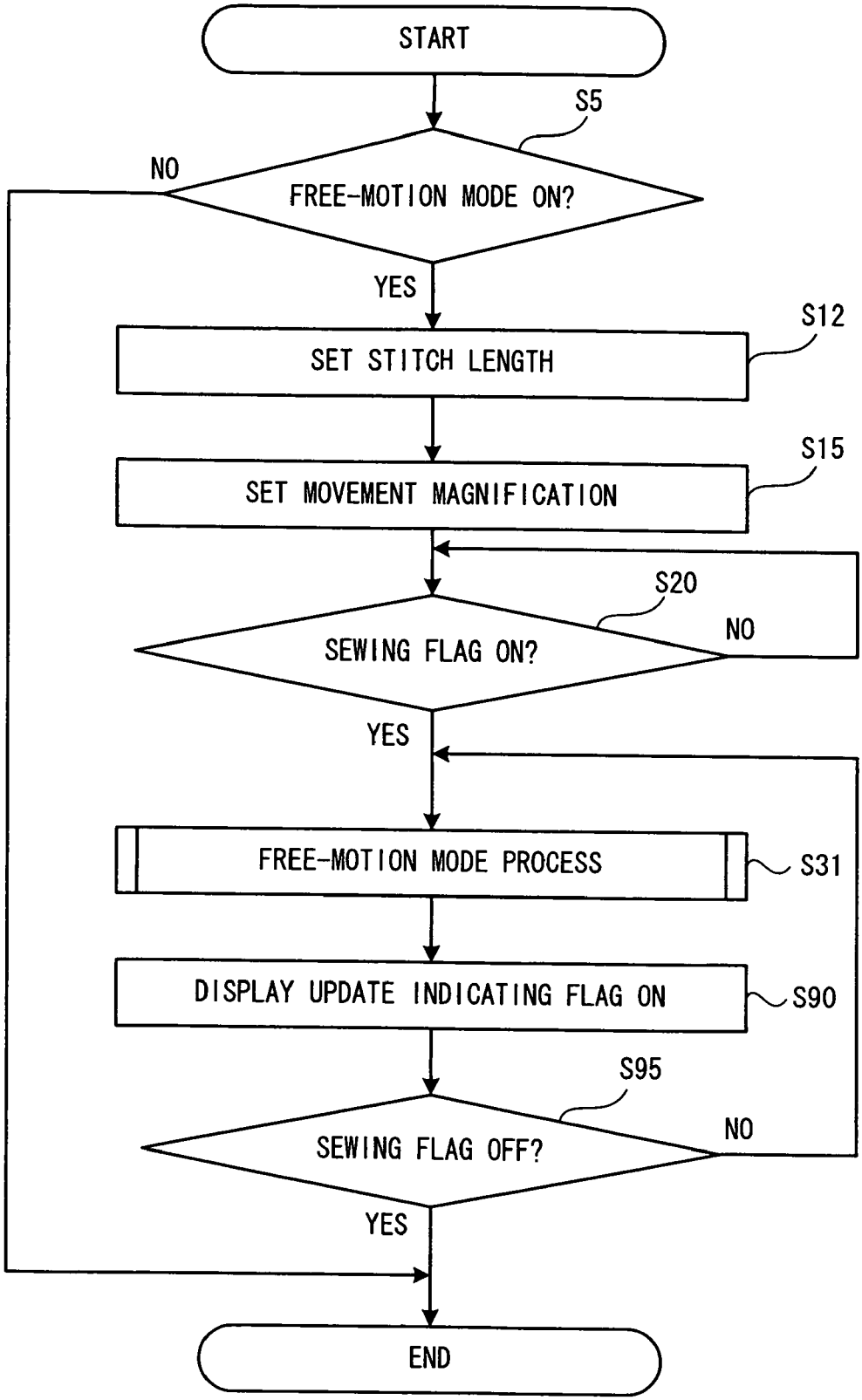
FIG. 13 is a flowchart of the free-motion sewing process.
Figure 14:
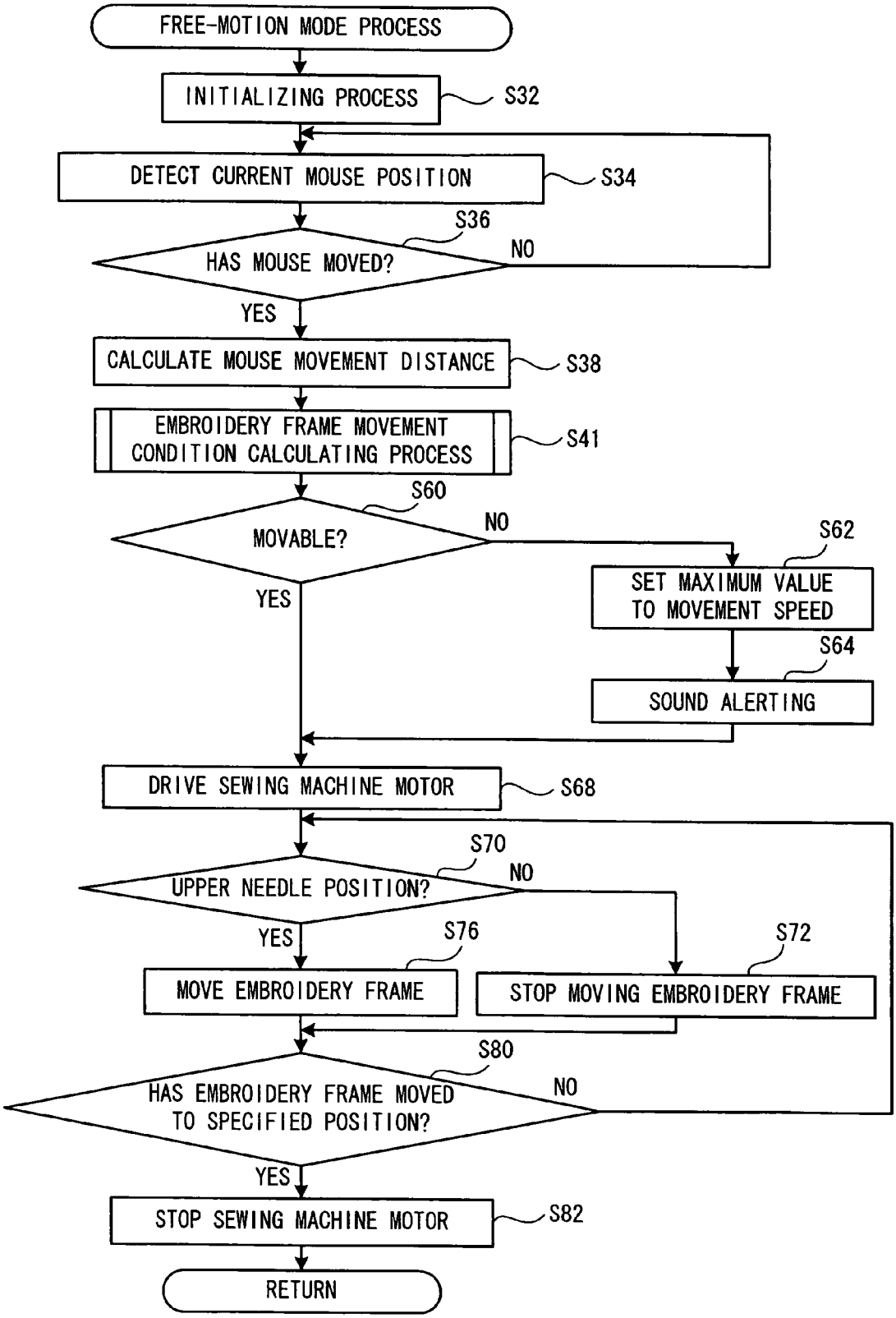
FIG. 14 is a flowchart of a free-motion mode process executed in the free-motion sewing process of FIG. 13.
Figure 15:
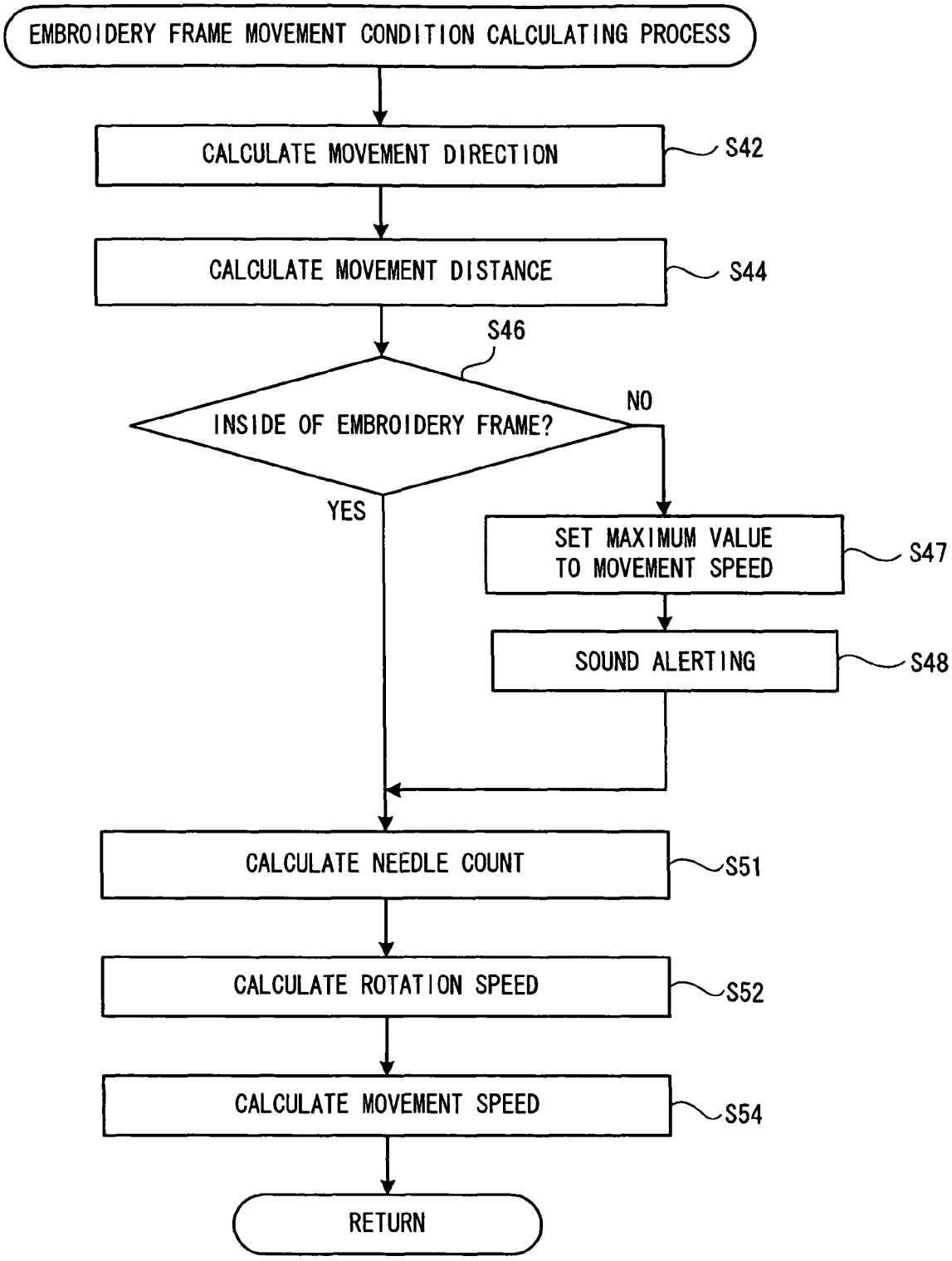
FIG. 15 is a flowchart of an embroidery frame movement condition calculating process executed in the free-motion mode process of FIG. 14.

Programs for executing processing operations shown in FIGS. 13 to 15 may be stored in the ROM 62, the stored programs may be read into the program storage area 631 of the RAM 63 at the time of program execution, and the read program may be executed by the CPU 61. In addition, a variety of information that may be used to execute the free-motion sewing process may be read out from the ROM 62, the EEPROM 64, or the external storage device 39, and then, the readout may be stored in the setting storage area 632 of the RAM 63.

Figure 12:
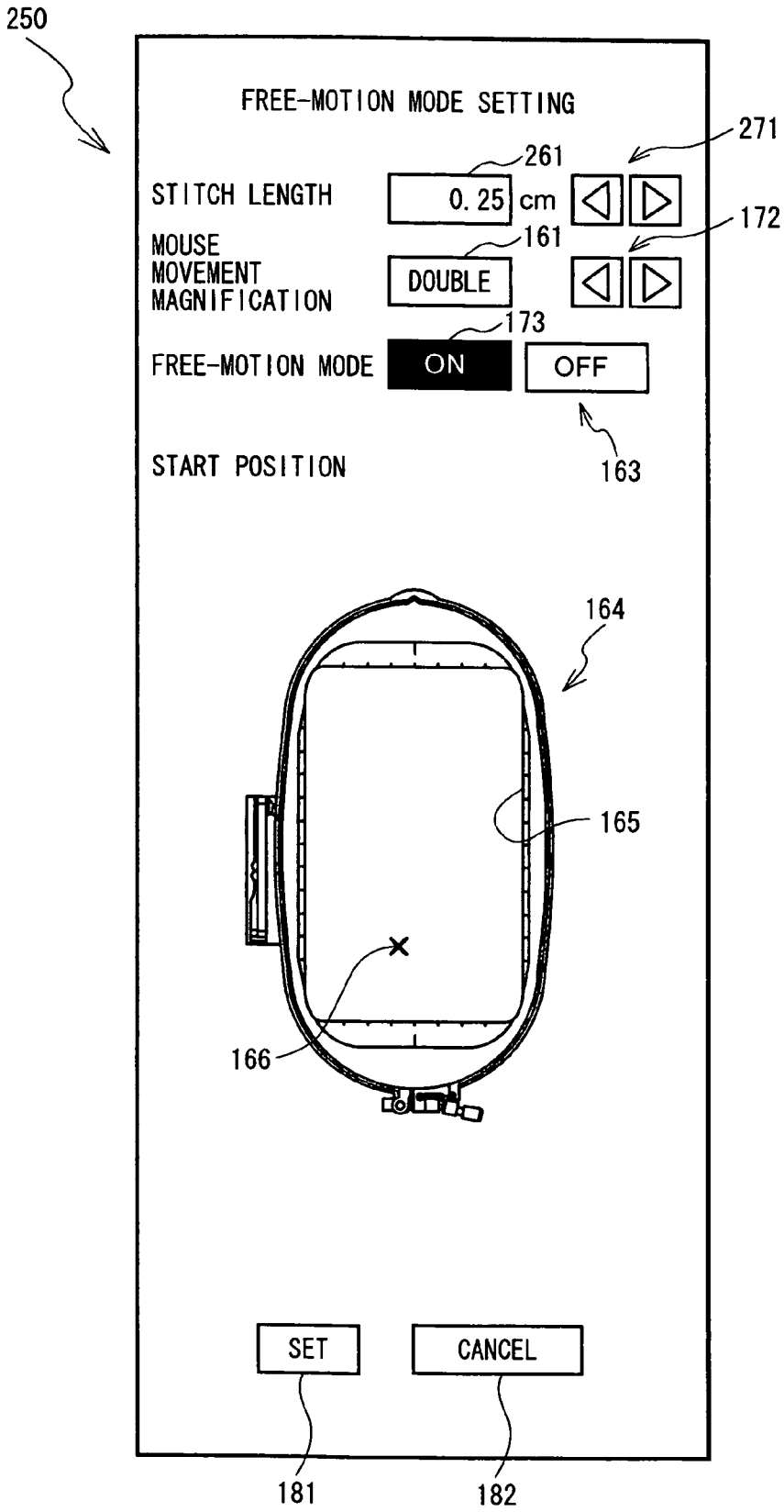
FIG. 12 is an illustrative view of a screen for setting a sewing condition at the time of executing the free-motion sewing process.

First, a screen 250 for setting a condition for executing the free-motion sewing process of the second embodiment will be described with reference to, for example, FIG. 12. On the screen 250 shown in FIG. 12, a stitch length field 261 and adjustment keys 271 may be provided in place of the rotation speed field 161 and the adjustment keys 171 on the screen 150 shown in FIG. 5. In the stitch length field 261, stitch length may be set, which is a condition at the time of executing the free-motion sewing process. The adjustment keys 271 may be operated to set the stitch length displayed on the stitch length field 261. The stitch length may be set by way of selecting the adjustment keys 271 with the use of panel operation or mouse operation. Other display items and associated operation methods may be similar to those on the screen 150 shown in FIG. 5 and descriptions are omitted here.

Next, the free-motion sewing process of the second embodiment will be described with reference to FIG. 13. The free-motion sewing process of the second embodiment may be different from that of the first embodiment in that S12 and S31 may be carried out in place of S10 and S30 of the first embodiment shown in FIG. 6. The processing operations similar to those of the first embodiment are not described here. Hereinafter, the processing steps S12 and S31 which may be different from the first embodiment will be described with reference to, for example, FIGS. 13 to 15.

In S12 of FIG. 13, the CPU 61 may set the stitch length, and may store the stitch length into the sewing condition storage area 635 (S12). For example, the CPU 61 may read the stitch length specified by the screen 250 shown in FIG. 12, and then may store the read stitch length into the stitch condition storage area 635.

Next, a description of the free-motion mode process of the second embodiment, executed in S31 of FIG. 13, will be given with reference to FIG. 14. As shown in FIG. 14, the free-motion mode process of the second embodiment may be different from that of the first embodiment shown in FIG. 7 in that S41, S68, and S76 may be carried out in place of S40, S66, and S74. The processing operations similar to those of the first embodiment are not described here. Hereinafter, S41, which may be the difference from the first embodiment, will be described with reference to, for example, FIG. 15, and then, S68 and S76 will be described with reference to, for example, FIG. 14.

First, a description of S41 of FIG. 14 will be given with reference to FIG. 15. As shown in FIG. 15, an embroidery frame movement condition calculating process of the second embodiment may be different from that of the first embodiment shown in FIG. 7 in that S51 and S52 may be carried out in place of S50. Processing operations similar to those of the first embodiment are not described here. Hereinafter, S51 and S52, which may be different from the first embodiment, will be described sequentially.

In S51, the CPU 61 may calculate the number of stitches to be formed with the use of the movement distance (movement amount) of the embroidery frame 34 and the stitch length, may store the calculation result into the movement condition storage area 636, and may set a current stitch length (S51). The number of stitches to be formed may be obtained from (movement distance of the embroidery frame 34 set in S44 or S47)/(stitch length set in S12 of FIG. 13). When the number of stitches to be formed is an integer, the CPU 61 may store the stitch length set in S12 of FIG. 13 as the current stitch length into the movement condition storage area 636. When the number of stitches to be formed is not an integer, the CPU 61 may truncate a fractional portion, and then, obtains the integer number of stitches. Then, the CPU 61 may calculate (movement distance of the embroidery frame 34 set in S44 or S47)/(integer number of stitches), and then, may store the calculation result into the movement condition storage area 636 (S51). In the process for setting the current stitch length in S51, the CPU 61 may set the stitch length of a stitch formed in the free-motion sewing process so as to be substantially constant.

Following S51, the CPU 61 may calculate the rotation speed of the sewing machine motor 79, and may store the calculation result into the movement condition storage area 636 (S52). For example, the CPU 61 may calculate the rotation speed of the drive shaft 51 from (the number of stitches to be formed)/(mouse polling time), and then, may calculate the rotation speed of the sewing machine motor 79 from the rotation speed of the drive shaft 51 and the deceleration ratio.

Next, S68 and S76, which may be executed in the free-motion mode process shown in FIG. 14 will be described with reference to FIG. 14. In S68 of FIG. 14, the CPU 61 may instruct the drive circuit 72 to drive the sewing machine motor 79 to start sewing (S68). For example, the CPU 61 may control the rotation speed of the sewing machine motor 79 so as to be equal to that of the sewing machine motor 79 obtained in S52 of FIG. 15 with reference to the movement condition storage area 636.

In addition, in S76, the CPU 61 may instruct the drive circuits 76 and 77 to drive the X-axis motor 81 and the Y-axis motor 82 to move the embroidery frame 34 (S76). For example, the CPU 61 may move the embroidery frame 34 for a period of a movable time at the movement speed that may be calculated in S54 in the movement direction that may be calculated in S42 of FIG. 15 with reference to the movement condition storage area 636. In this process, the embroidery frame 34 may be moved by the current stitch length set in S51 of FIG. 15 in the movement direction obtained in S42.

Figure 16:
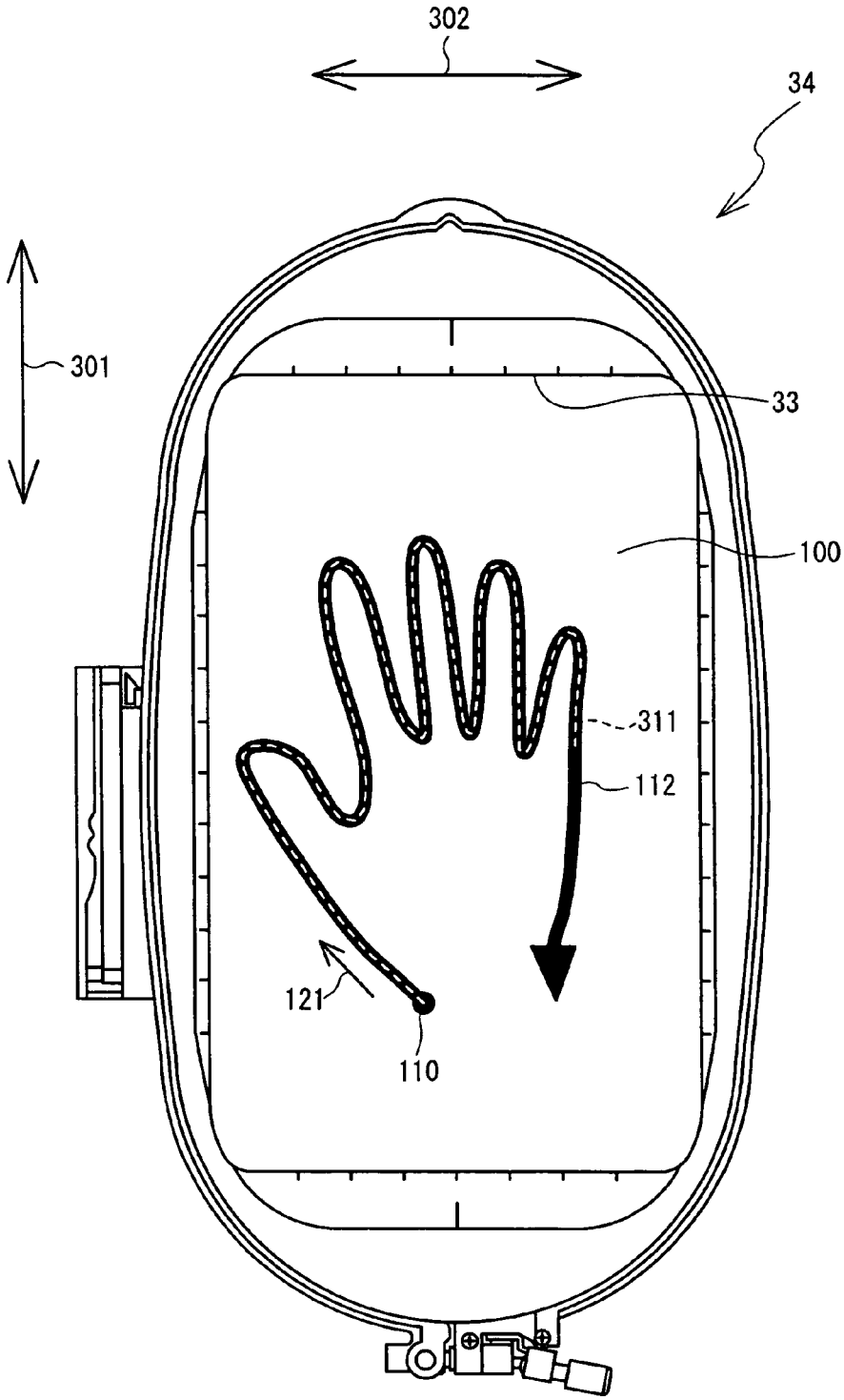
FIG. 16 is an illustrative view of a stitch formed in a free-motion sewing process.

Free-motion sewing may be executed by the free-motion sewing process of the second embodiment described above in detail. In the free-motion sewing process, when the user may operate the mouse 27 so as to draw the shape of a hand, a stitch line 311 as shown in FIG. 16 may be formed on the work cloth 100. Because items other than the stitch line 311 shown in FIG. 16 may be similar to those of the first embodiment shown in FIG. 9, a description will be omitted here. As shown in FIG. 16, the stitch line 311 may be formed so as to overlap with the stitch position indication line 112 that may be formed in the direction indicated by the arrow 121 from the start position 110. The stitch length of the stitches constituting the stitch line 311 may indicate the value set in S12 shown in FIG. 13 or a value approximate to that set in S12. As described above, the CPU 61 may execute the free-motion sewing process of the second embodiment.

According to the sewing machine 1 of the second embodiment described above in detail, the CPU 61 may control the sewing machine motor 79 so that the rotation speed of the sewing machine motor 79 may be equal to the rotation speed of the sewing machine motor 79 that may be determined based on the output signal outputted from the mouse 27 and the stitch length set by panel operation or mouse operation. In addition, the CPU 61 may control the embroidery frame movement mechanism 92 so that the movement distance (movement amount) of the embroidery frame 34 per one needle stroke may be equal to the set stitch length. Thus, even when the movement distance per unit time of the embroidery frame 34 instructed by the output signal is not constant, the stitch length of stitches to be formed may be set by a user. Therefore, even a user unfamiliar with free-motion sewing may from stitches in which the stitch lengths are uniform, by free-motion sewing.

Various modifications may be employed in the embodiments described above. For example, while the forgoing embodiments have shown the sewing machine 1, which may be provided with one needle bar 40, the present disclosure is not limited to it. For example, the present disclosure may be applied to an industrial sewing machine or a multi-needle type embroidery sewing machine provided with a plurality of needle bars. In addition, the size and shape of the embroidery frame 34 may be properly modified.

In addition, in the embodiments described above, a user may have operated the mouse 27 with a wheel 28 connected to the sewing machine body 2 by a cable. However, instead of the mouse 27, other devices, which may be capable of indicating the movement direction and the movement distance (movement amount) of the embroidery frame 34 corresponding to an operation by a user, may be employed. For example, a mouse without a wheel or a mouse for outputting an output signal wirelessly may be employed. Anything that interfaces with a user may also be employed, such as, a variety of switches including a touch panel 26, a digitizer, a tablet, and a game controller, a trackball and a joystick, for example. In this case, a signal, which may correspond to an operation state of the device such as pressing a switch, a button, and touch panel or rotating a rotor, may be outputted. Similarly, while, in the embodiments described above, the mouse 27 or the touch panel 26 may have been employed to set the movement magnification, the present disclosure is not limited to those configurations. For example, anything that interfaces with a user may also be employed for setting of the movement magnification, such as, a variety of switches including a game controller, a trackball and a joystick, for example. These devices may be employed solely or in combination with a plurality thereof. In addition, as a method of specifying a position of stitch forming of free-motion sewing, variety of methods may be employed. The movement direction and the movement distance may be specified by, for example, moving the above-described equipments or pressing buttons and switches or the like of the above described equipments.

While, in the embodiments described above, the LCD 15 may have been employed, the present disclosure is not limited to it. Other display devices such as an organic EL or electronic paper may be employed. In addition, the size, shape, and layout position or the like, of the display device, may be changed as required.

In addition, in the embodiments described above, for the sake of simplification, it may be assumed that a movement output signal indicating the movement direction and the movement distance (movement amount) of the mouse 27 may be outputted at each mouse position polling time from the movement detection section 35. However, a timing with which the output signal is outputted from the movement detection section 35 is not limited to the case of the embodiments described above. For example, the movement detection section 35 may output an output signal only when it may be determined that the mouse 27 has moved.

Further, in the embodiments described above, the x-axis direction of the mouse 27 may correspond to the X-axis direction of the embroidery frame 34 and the y-axis direction of the mouse 27 may correspond to the Y-axis direction of the embroidery frame 34, the present disclosure is not limited to it. It may be sufficient if a correlation between the movement direction of the mouse 27 and that of the embroidery frame 34 is predetermined. For example, the x-axis direction of the mouse 27 may correspond to the Y-axis direction of the embroidery frame 34 and the y-axis direction of the mouse 27 may correspond to the X-axis direction of the embroidery frame 34. For example, it may be assumed that a long stitch line along the transverse direction is formed by free-motion sewing with the use of the sewing machine 1 of the embodiments described above. In this case, the x-axis direction of the mouse 27 may be associated with the Y-axis direction of the embroidery frame 34, and the y-axis direction of the mouse 27 may be associated with the X-axis direction of the embroidery frame 34, whereby the embroidery frame 34 may be used as if the frame is long along the transverse direction. In addition, for example, the movement position of the embroidery frame 34 may be obtained by rotating the mouse position that may be obtained from the xy relative coordinate of the mouse 27 by a predetermined angle. In these cases, at the time of program execution, the CPU 61 may read a correlation between the movement direction of the mouse 27 and that of the embroidery frame 34 from a storage device such as the ROM 62, the EEPROM 64 or an external storage device 39 in a predetermined storage area of the RAM 63. Then, the CPU 61 may reference the correlation in movement direction that may be stored in the RAM 63 in a process for associating the movement direction of the mouse 27 with that of the embroidery frame 34. In these cases, it may be difficult to grasp a stitch line formed by operation of the mouse 27, because the movement direction of the mouse 27 may be different from that of the embroidery frame 34. Thus, the stitch line may preferably be displayed by the free-motion mode display process as in the embodiments described above. In the free-motion mode display process of the embodiments described above, the y-axis direction of the mouse 27 may be associated with the longitudinal direction of the LCD 15.

In the embodiments described above, the movement magnification of both of the X-axis direction and the Y-axis direction may have been specified by the movement magnification set in the free-motion sewing process shown in FIG. 6, different movement magnifications may be specified depending on the X-axis direction and the Y-axis direction. In addition, the movement distance of the embroidery frame 34 may be obtained with the use of the predetermined movement magnification in place of the movement magnification specified by the user. In that case, at the time of program execution, the CPU 61 may read the movement magnification from a storage device such as the ROM 62, the EEPROM 64 or the external storage device 39 in a predetermined storage area of the RAM 63. Then, the CPU 61 may reference the movement magnification stored in the RAM 63 in the process for associating the movement distance of the mouse 27 with the movement distance of the embroidery frame 34.

Figure 11:
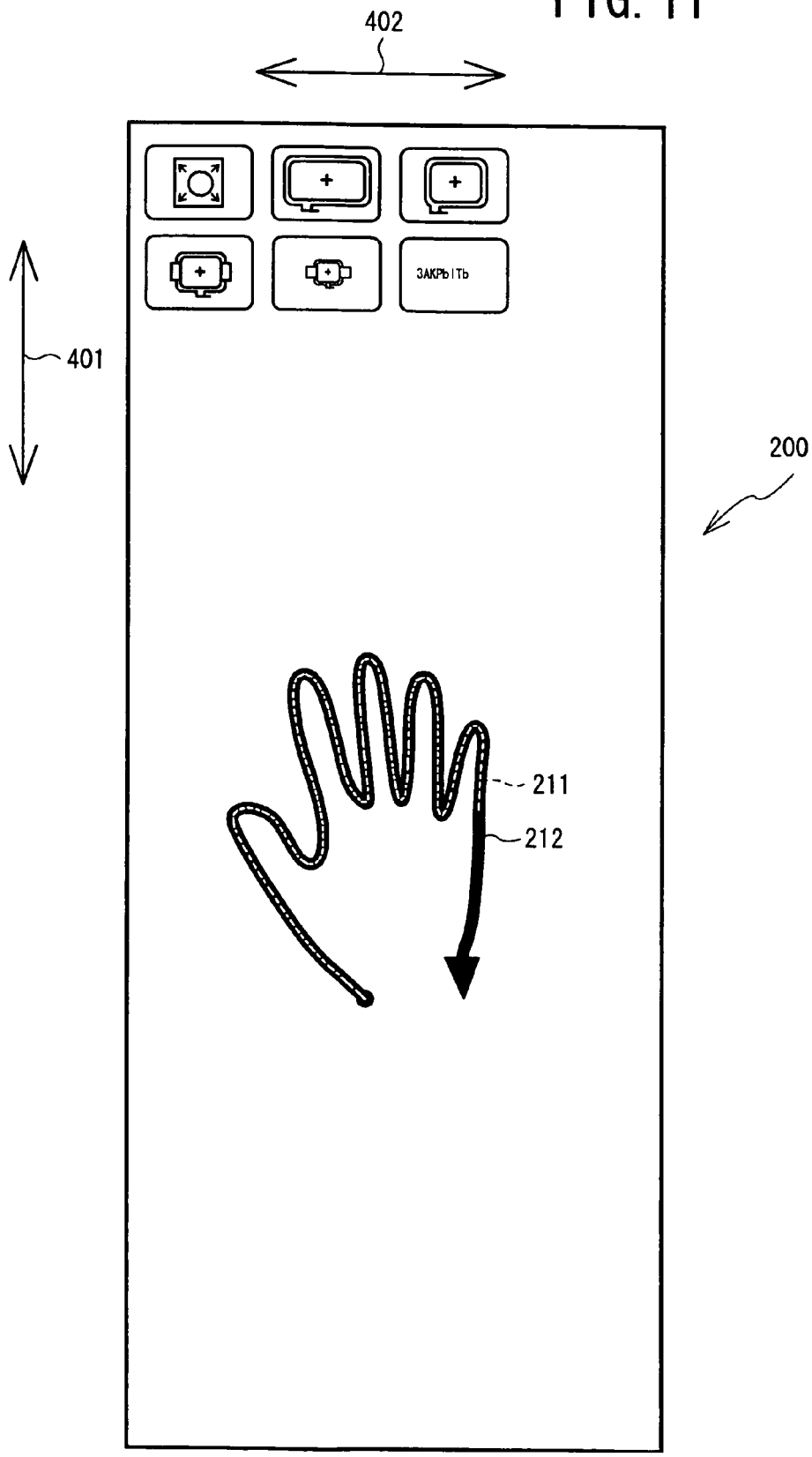
FIG. 11 is an illustrative view of a screen displayed on an LCD in the free-motion mode display process.

In the embodiments described above, the CPU 61 may display the screen 200 on which the stitch line 211 and the stitch position indication line 212 shown in FIG. 11, in the free-motion mode display process shown in FIG. 10, the items and display format or the like displayed on the screen 200 may be changed as desired. For example, the CPU 61 may be caused to display only the stitch line 211 on the screen 200, or alternatively may be caused to properly display an illustration representing the embroidery frame 34 and virtual grids which serve as reference positions indicating the positions of stitches, or the like as well as the stitch line 211 and the stitch position indication line 212. In addition, the free-motion mode display process shown in FIG. 10 may be omitted.

In the embodiments described above, the CPU 61 may move the embroidery frame 34 so as to follow the movement of the mouse 27. However, by free-motion sewing, a timing at which a stitch may be formed at a position indicated by the mouse 27 is not limited thereto. For example, free-motion sewing may be executed after the user has checked the stitch position indication line, which may correspond to the movement of the mouse 27, on the LCD 15. In this case, for example, during a period in which no instruction for executing free-motion sewing is input, the CPU 61 should not execute processing steps of S66 to S82 in the free-motion mode process shown in FIG. 7. In the free-motion mode display process shown in FIG. 10, the CPU 61 may cause the LCD 15 to display the stitch line obtained based on these output signals as needed. Then, when an instruction for executing free-motion sewing as in the stitch line displayed on the LCD 15 has been inputted, the CPU 61 may sequentially read the movement condition of the embroidery frame 34 that may be stored in the movement condition storage area 636 of the RAM 63. Then, the CPU 61 may execute the processing steps of S66 to S82 in the free-motion mode process shown in FIG. 7 to form stitches corresponding to the output signals from the mouse 27. In this case, the CPU 61 may actually execute free-motion sewing after checking the stitch line to be formed based on the output signals outputted from the mouse 27, thus it may be possible to avoid forming of stitches at positions that are undesired by the user.

While the sewing machine 1 of the second embodiment has formed stitches so as to obtain the stitch length set by the mouse operation or the panel operation, the method of setting the stitch length may not be limited to the second embodiment. For example, when the proper stitch length is determined according to features of a sewing target such as a material for, or thickness of, a work cloth and a material for, or thickness of, a thread, the CPU 61 may set the features of the sewing target, whereby the stitch length may be set indirectly. In that case, a relationship between the features of the sewing target and the stitch length may be stored in advance in a storage device such as the ROM 62 and the EEPROM 64. Then, the CPU 61 may read out the stitch length that corresponds to the features of the sewing target set by the user with reference to the relationship between the features of the sewing target and the stitch length.

In addition, in the second embodiment, in the embroidery frame movement condition calculating process shown in FIG. 15, the number of stitches to be formed may be obtained from (movement distance of the embroidery frame 34 set in S44 or S47)/(stitch length set in S12 of FIG. 13). While the fractional portion may be truncated when the number of stitches to be formed is not an integer, the present disclosure is not limited thereto. For example, the movement distance of the embroidery frame 34 that corresponds to the a fractional portion of the calculation results of the number of stitches to be formed may be accumulated on the movement distance of the embroidery frame 34 obtained in S44 of the embroidery frame movement condition calculating process to be executed next time. In this case, all of the stitch lengths of stitches included in a stitch line formed by free-motion sewing may be obtained as those set in S12 of FIG. 13, thus making it possible to obtain stitches with uniform stitch lengths. In addition, while, when the number of stitches to be formed is not an integer, if the fractional portion is truncated, the current stitch length may be set from (movement distance of the embroidery frame 34 set in S44 or S47)/(the number of stitches to be formed of integer), the present disclosure is not limited thereto. For example, all of the stitches may be stitched in accordance with the stitch length set in S12 of FIG. 13 without setting the current stitch length.

The embodiments described above and modifications thereof may be combined as required.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A sewing machine comprising:

a needle bar;

a needle bar vertical movement mechanism that vertically moves the needle bar;

a sewing machine motor that drives the needle bar vertical movement mechanism;

an embroidery frame that holds a work cloth;

an embroidery frame movement mechanism that moves the embroidery frame;

an operation device including an operation member to be operated by a user, the operation device outputting an output signal corresponding to at least an operation state of the operation member, the operation member being an object that is freely-movable in at least two dimensions, and a change in the operation state corresponding to a movement of the operation member within the at least two dimensions;

a movement determination device that determines a movement direction and a movement distance of the embroidery frame based on the output signal outputted by the operation device;

an embroidery frame movement mechanism control device that drives the embroidery frame movement mechanism to move the embroidery frame according to the movement direction and the movement distance of the embroidery frame determined by the movement determination device;

a sewing machine motor control device that controls a rotation speed of the sewing machine motor based on the output signal outputted from the operation device, the embroidery frame movement mechanism and the sewing machine motor being driven in synchronization to form a stitch on the work cloth held by the embroidery frame; and a movement magnification setting device that sets a correlation between the output signal and the movement distance of the embroidery frame as a movement magnification, wherein the movement determination device determines the movement direction and the movement distance of the embroidery frame based on the output signal outputted from the operation device and the movement magnification set by the movement magnification setting device.

2. The sewing machine according to claim 1, further comprising:

a stitch length setting device that sets a stitch length of the stitch to be formed on the work cloth; and a rotation speed determination device that determines the rotation speed of the sewing machine motor based on the output signal outputted from the operation device and the stitch length set by the stitch length setting device, wherein the sewing machine motor control device controls the sewing machine motor such that the rotation speed of the sewing machine motor is equal to the rotation speed determined by the rotation speed determination device; and the embroidery frame movement mechanism control device controls the embroidery frame movement mechanism such that a movement distance of the embroidery frame per one needle stroke is equal to the stitch length determined by the stitch length setting device.

3. The sewing machine according to claim 1, further comprising:

a needle drop point calculation device that calculates a needle drop point based on the output signal outputted from the operation device; and a display device that displays the needle drop point calculated by the needle drop point calculation device.

4. The sewing machine according to claim 1, wherein the operation device is a pointing device.

5. The sewing machine according to claim 1, wherein:

the operation device is a mouse, the mouse outputting the output signal corresponding to a movement direction and a movement distance of the mouse; and the movement determination device determines the movement direction of the embroidery frame based on the output signal corresponding to the movement direction of the mouse outputted from the mouse, and determines the movement distance of the embroidery frame based on the output signal corresponding to the movement distance of the mouse outputted from the mouse.

6. A non-transitory computer-readable recording medium storing a sewing machine operation program for a sewing machine including an embroidery frame that holds a work cloth, an embroidery frame movement mechanism that moves the embroidery frame, and an operation device including an operation member to be operated by a user and outputting an output signal corresponding to an operation state of the operation member, the program comprising:

instructions for acquiring an output signal corresponding to at least the operation state of the operation member, the operation member being an object that is freely-movable in at least two dimensions, and a change of the operation state corresponding to a movement of the operation member within the at least two dimensions;

instructions for determining a movement direction and a movement distance of the embroidery frame based on the output signal;

instructions for driving the embroidery frame movement mechanism to move the embroidery frame according to the movement direction and the movement distance of the embroidery frame;

instructions for controlling a rotation speed of a sewing machine motor based on the output signal outputted from the operation device, the embroidery frame movement mechanism and the sewing machine motor being driven in synchronization to form a stitch on the work cloth held by the embroidery frame; and instructions for setting a correlation between the output signal and the movement distance of the embroidery frame as a movement magnification, wherein the movement direction and the movement distance of the embroidery frame is determined based on the output signal and the movement magnification.

7. The non-transitory computer-readable recording medium according to claim 6, further comprising:

instructions for setting a stitch length of the stitch formed on the work cloth; and instructions for determining the rotation speed of the sewing machine motor based on the output signal and the stitch length, wherein the sewing machine motor is controlled such that the rotation speed of the sewing machine motor is substantially equal to the rotation speed determined based on the output signal, and wherein the embroidery frame movement mechanism is controlled such that a movement distance of the embroidery frame per one needle stroke is substantially equal to the stitch length.

8. The non-transitory computer-readable recording medium according to claim 6, further comprising:

instructions for calculating a needle drop point based on the output signal; and instructions for displaying the needle drop point.

9. The non-transitory computer-readable recording medium according to claim 6, wherein the output signal corresponds to a movement direction and a movement distance of a mouse as the operation device, and wherein the movement direction of the embroidery frame is determined based on the output signal corresponding to the movement direction of the mouse outputted from the mouse, and the movement distance of the embroidery frame is determined based on the output signal corresponding to the movement distance of the mouse outputted from the mouse.

* * * * *